US007082873B2

(12) United States Patent
DeMoore et al.

(10) Patent No.: US 7,082,873 B2
(45) Date of Patent: Aug. 1, 2006

(54) INEXPENSIVE, WASH-FREE INTEGRATED COVER FOR PRINTING PRESS TRANSFER CYLINDERS

(75) Inventors: Howard W. DeMoore, Dallas, TX (US); James A. Elliott, Euless, TX (US); Bryan G. Argenbright, Cedar Hill, TX (US)

(73) Assignee: Printing Research, Inc., Dallas, TX (US)

( * ) Notice: Subject to any disclaimer, the term of this patent is extended or adjusted under 35 U.S.C. 154(b) by 46 days.

(21) Appl. No.: 10/083,785

(22) Filed: Feb. 25, 2002

(65) Prior Publication Data

US 2003/0159605 A1 Aug. 28, 2003

(51) Int. Cl.
*B41F 5/00* (2006.01)
*B41F 13/24* (2006.01)
*B41L 47/60* (2006.01)

(52) U.S. Cl. ..... 101/216; 101/232; 101/482; 101/483

(58) Field of Classification Search ..... 101/416.1, 101/216, 483, 232, 492, 416, 482; 430/497
See application file for complete search history.

(56) References Cited

U.S. PATENT DOCUMENTS 3,934,509 A * 1/1976 Saunders et al. ..... 101/415.1
4,188,882 A * 2/1980 Jeschke et al. ..... 101/148
4,694,750 A * 9/1987 Greene ..... 101/483
5,009,160 A 4/1991 Duarte ..... 101/422
5,103,729 A * 4/1992 Philpot ..... 101/415.1
5,127,327 A * 7/1992 Philpot ..... 101/415.1
5,410,964 A * 5/1995 Koelsch ..... 101/378
5,413,044 A * 5/1995 Wu et al. ..... 101/420
5,476,043 A * 12/1995 Okuda et al. ..... 101/483
5,885,738 A * 3/1999 Hannon ..... 430/97
5,979,322 A * 11/1999 DeMoore et al. ..... 101/401.1
6,316,261 B1 * 11/2001 Grandgenett ..... 435/462
2003/0001511 A1 1/2003 Howald et al.

FOREIGN PATENT DOCUMENTS

DE 199 56 352 7/2001

* cited by examiner

*Primary Examiner*—Andrew H. Hirshfeld
*Assistant Examiner*—Marvin P. Crenshaw
(74) *Attorney, Agent, or Firm*—Conley Rose, P.C.; Rodney B. Carroll

(57) ABSTRACT

The invention is a simple, inexpensive, wash-free integrated cover for a printing transfer cylinder (preferably, but not necessarily, in a Komori press), comprising a flexible jacket covering permanently attached to a cylinder base cover. The invention provides advantages over T-Y paper and non-tack film in that dampening solution, washing, and cleaning causes failure in both over time, whereas dampening solution is beneficial to the present invention as such is retained in the flexible jacket cover and helps to prevent ink buildup and marking. The flexible jacket covering is moveable relative to the cylinder base cover, thereby further reducing ink buildup and marking. The integrated cover is disposable, which reduces periodic maintenance and cleaning of the transfer cylinder coverings and provides for fresh, clean substrate support surfaces upon each new installation. The flexible jacket covering and cylinder base cover are integrated into a single, convenient unit, thereby speeding and simplifying installation.

45 Claims, 17 Drawing Sheets

INEXPENSIVE, WASH-FREE INTEGRATED COVER FOR PRINTING PRESS TRANSFER CYLINDERS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention concerns an apparatus for reducing marking and smearing of freshly printed substrate material in a printing press and methods for making and using same.

BACKGROUND OF THE INVENTION

In the operation of a rotary offset printing press, freshly printed substrates such as sheets or web material are guided by transfer cylinders or the like from one printing unit to another, and then they are delivered to a sheet stacker or to a sheet folder/cutter unit, respectively. As used herein, the term "transfer cylinder" includes delivery cylinders, transfer rollers, support rollers, support cylinders, delivery wheels, skeleton wheels, segmented wheels, transfer drums, support drums, spider wheels, support wheels, guide wheels, guide rollers and the like.

The ink marking problems inherent in transferring freshly printed substrates have been longstanding. In order to minimize the contact area between the transfer means and the freshly printed substrate, conventional support wheels have been modified in the form of relatively thin disks having a toothed or serrated circumference, referred to as skeleton wheels. However, those thin disc transfer means have not overcome the problems of smearing and marking the freshly printed substrate due to moving contact between the freshly printed substrate and the projections or serrations. Moreover, the attempts to cover the transfer cylinder with a cover material and/or minimize the surface support area in contact with the freshly printed substrate material often resulted in further problems.

Various efforts have been made to overcome the limitations of thin disk skeleton wheels. One of the most important improvements has been completely contrary to the concept of minimizing the surface area of contact. That improvement is disclosed and claimed in my U.S. Pat. No. 3,791,644 to Howard W. DeMoore, incorporated by reference herein in its entirety, wherein the support surface of a transfer cylinder in the form of a wide wheel or cylinder is coated with an improved ink repellent surface formed by a layer of polytetrafluoroethylene (PTFE).

During the use of the PTFE coated transfer cylinders in high-speed commercial printing presses, the surface of the coated cylinders must be washed too frequently with a solvent to remove any ink accumulation. Moreover, it has also been determined that the PTFE coated cylinders do not provide a critically needed cushioning effect and relative movement.

The limitations on the use of the PTFE coated transfer cylinders have been overcome with an improved transfer cylinder having an ink repellent, cushioning and supportive fabric covering or the like for transferring the freshly printed sheet. It is now well recognized and accepted in the printing industry world-wide that marking and smearing of freshly printed sheets caused by engagement of the wet printed surface with the supporting surface of a conventional press transfer cylinder is substantially eliminated by using the anti-marking fabric covering system as disclosed and claimed in my U.S. Pat. No. 4,402,267 entitled "Method and Apparatus for Handling Printed Substrate Material", the disclosure of which is incorporated herein by reference.

That system, which is marketed under license by Printing Research, Inc. of Dallas, Tex., U.S.A. under the registered trademark SUPER BLUE® includes the use of a low friction coating or coated material on the supporting surface of the transfer cylinder, and over which is loosely attached a movable fabric covering. The fabric covering provided a yieldable, cushioning support for the freshly printed side of the substrate such that relative movement between the freshly printed substrate and the transfer cylinder surface would take place between the fabric covering and the support surface of the transfer cylinder so that marking and smearing of the freshly printed surface was substantially reduced. Various improvements have been made to the SUPER BLUE system, which are described in more detail in U.S. Pat. Nos. 6,244,178 and 5,907,998 each entitled "Anti-Static, Anti-Smearing Pre-Stretched and Pressed Flat, Precision-Cut Striped Flexible Coverings for Transfer Cylinders"; U.S. Pat. Nos. 6,119,597, 5,603,264, 6,073,556, and 5,511,480 each entitled "Method and Apparatus for Handling Printed Sheet Material"; U.S. Pat. No. 6,192,800 entitled "Method and Apparatus for Handling Printed Sheet Material"; and U.S. Pat. No. 5,979,322 entitled "Environmentally Safe, Ink Repellent, Anti-Marking Flexible Jacket Covering Having Alignment Stripes, Centering Marks and Pre-Fabricated Reinforcement Strips for Attachment onto Transfer Cylinders in a Printing Press", each of which is hereby incorporated by reference herein in its entirety.

Despite the advantages of my previously described anti-marking systems, the printing industry continues to use obsolete transfer cylinder cover materials such as T-Y paper and non-tack film. T-Y paper comprises a paper backing with grit laminated thereon, producing a laminate material resembling sandpaper, and is sometimes referred to as sphere-coat or gem-kote. Non-tack film comprises a film backing such as polyester with silicon beads laminated thereon, also producing a gritty, sandpaper-like material sometimes referred to as Pearl-Tex, Spectra film, or ICP film. T-Y paper and non-tack film are releasably attached to a transfer cylinder, for example by clamps on the transfer cylinder or by use of a spray adhesive or a double sided tape, and support a printed substrate traveling through a printing press. During the printing process moisture from the printed sheets, in the form of ink as well as moisture from the dampening system, is in contact with the gritty surface of the T-Y paper and non-tack film. The dampening system is the system by which ink, water, and other additives such as ink repellant chemicals are transferred in sequence to a plate cylinder, a blanket cylinder, and a printed sheet. Over time, the moisture from the printed sheet will begin to penetrate the gritty surface and/or accumulate thereon, thereby limiting the service life of the cover material. As the moisture penetrates the gritty surface, the cover materials, and in particular T-Y paper, begin to weaken and ultimately tear and fail. As ink accumulates on the gritty surface, the printed substrates may be undesirably marked and flawed by the accumulated ink, or the accumulated ink may flake off and cause press problems such as "hickeys" on the plate cylinder, the blanket cylinder, or both. In particular, portions of the gritty material or clumps of ink may accumulate on a blanket, plate, or impression cylinder causing unwanted small printing imperfections commonly known as "hickeys" to appear on the printed substrate. In order to reduce the accumulated ink, the T-Y paper and non-tack film may need to be cleaned, for example by wiping down the gritty surface with a sponge or solvent rag. While cleaning may temporarily help reduce ink accumulation, the cleaning further subjects the gritty surface material to moisture, thus accelerating the moisture penetration problem and further shortening the service life of the cover materials.

T-Y paper and non-tack film typically need to be regularly maintained, cleaned during a press stoppage, and periodically replaced. Regular maintenance is the regular washing and cleaning of the T-Y paper or non-tack film according to the manufacturers recommendations, which is typically at the end of a daily shift to avoid having ink dry on the covers between shifts or overnight. A printing press may have to be stopped during a run to clean of one or more cylinders in the press in order to remove accumulated ink or contaminants thereon that are causing an imperfection such as a hickey on the printed sheet, as discussed previously. Periodic replacement is the replacement of the T-Y paper or non-tack film as they wear out and are no longer operable. Regular maintenance, cleaning during a press stoppage, and periodic replacement lead to costly press down time and additional expenses. For example, a 4 color printing press may have from 6 to 8 transfer cylinders (and in particular a 4 color press made by Komori Corp. may have 6 or 8 transfer cylinders). A conservative estimate for the amount of time required to wash a single transfer cylinder is 3 minutes, and thus it can easily take 18 minutes during an 8 hour workshift for regular maintenance of T-Y paper and non-tack films on 6 transfer cylinders. Also, it is not uncommon to have to stop the press at least once during a shift to clean at least one cylinder (i.e., transfer cylinder, blanket cylinder, or plate cylinder) due to printing imperfections associated with T-Y paper and non-tack films, which would add even more lost press time. According to the Printing Industries of America, Inc.'s 1998 Production and Cost Standards Report, a typical, 40 inch four-color offset printing press has an all inclusive hourly cost rate of from about $300 to $500 per hour. Thus, a printing press operator may easily lose $90 per day (18 minutes×$5/min.) or more in press down time due to cleaning associated with T-Y paper and non-tack films, which typically increases with an increase in the number of shifts. Over the course of a year, a press operator may easily lose in excess of $20,000, which grows to in excess of $100,000 over a five-year period. Stopping a press for cleaning leads to wasted materials and additional losses and/or costs, as a number of printed substrates are typically off-specification (e.g., color and/or registration) and unsalable following re-start of the printing press. Also, the T-Y paper typically needs to be replaced at a frequency ranging from weekly to monthly at a price of about $16–30 per change per cylinder for a 40 inch press, and the non-tack film typically needs to be replaced about every three months at a cost of about $100 per change per cylinder for a 40 inch press. The present invention advances the state of the art by providing an inexpensive, wash-free, disposable, easy to install transfer cylinder cover that reduces or eliminates the problems and expenses associated with T-Y paper and non-tack films.

SUMMARY OF THE INVENTION

The present invention is an integrated, anti-marking cover for a transfer cylinder in a rotary printing press, comprising a flexible jacket covering permanently attached to a cylinder base cover. In an embodiment, the flexible jacket covering and cylinder base cover are aligned and permanently attached along their edges by means for permanently attaching, including stitching, adhesive, mechanical fasteners, and combinations thereof. In another embodiment, the flexible jacket covering is sized such that in areas not permanently attached to the cylinder base cover, a predetermined amount of movement of the flexible jacket covering is permitted relative to the cylinder base cover. In another embodiment, the cylinder base cover may be smooth, textured, perforated, or combinations thereof. In another embodiment, the flexible jacket covering, cylinder base cover, or both are conductive. In another embodiment, the integrated cover may further comprise means for releasably attaching the integrated cover to the transfer cylinder, means for aligning the integrated cover for attachment to the transfer cylinder, contrasting alignment stripes, or combinations thereof. The present invention also includes methods for manufacturing an integrated, anti-marking cover for a transfer cylinder, for attaching an integrated, anti-marking cover to a transfer cylinder in a rotary printing press, and for supporting a processed substrate in a rotary printing press.

DETAILED DESCRIPTION OF THE INVENTION

Figure 1A:
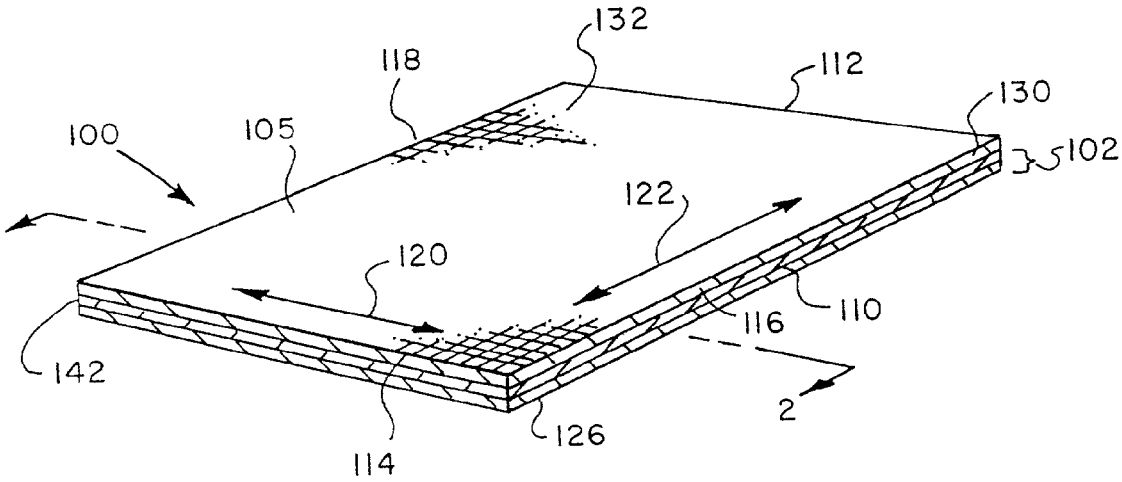
FIG. 1A is a perspective view of an integrated, anti-marking cover laying flat.
Figure 1B:
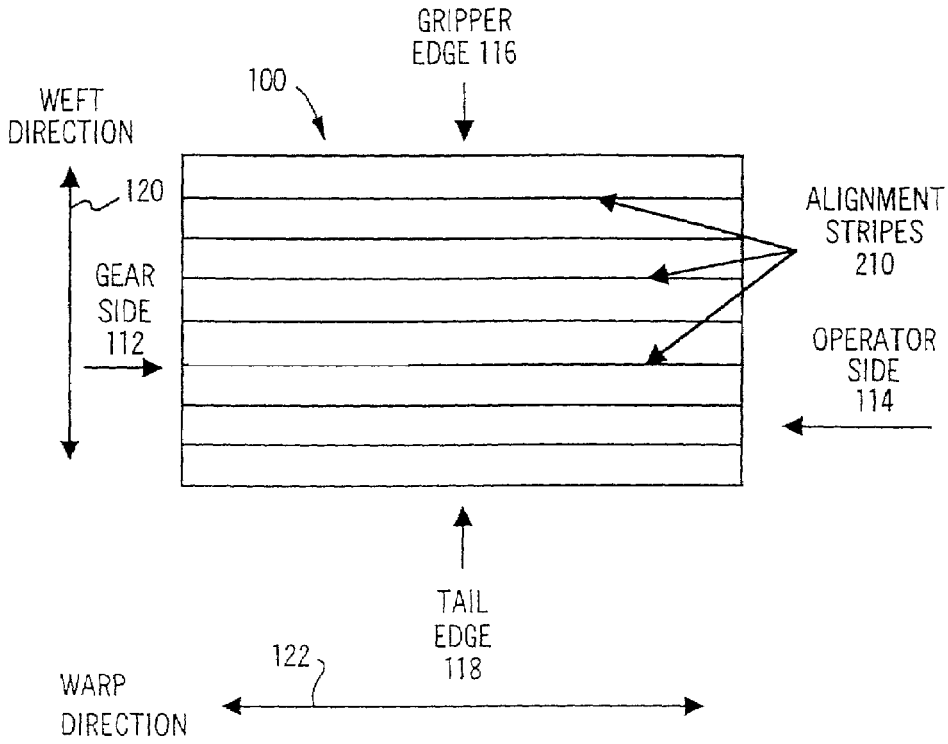
FIG. 1B is a top view of an integrated, anti-marking cover laying flat.
Figure 1C:
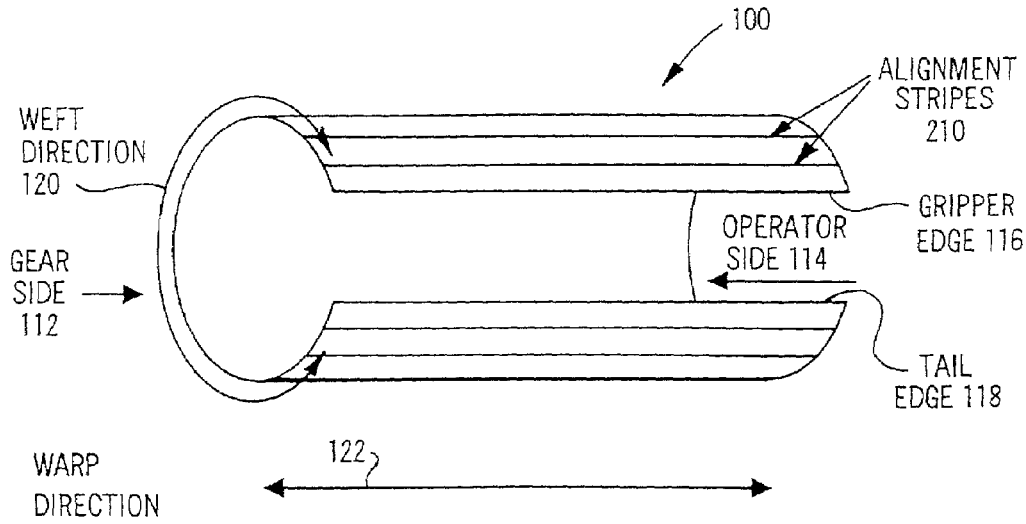
FIG. 1C is a perspective view of an integrated, anti-marking cover in a curved position simulating installation upon a transfer cylinder.
Figure 3:
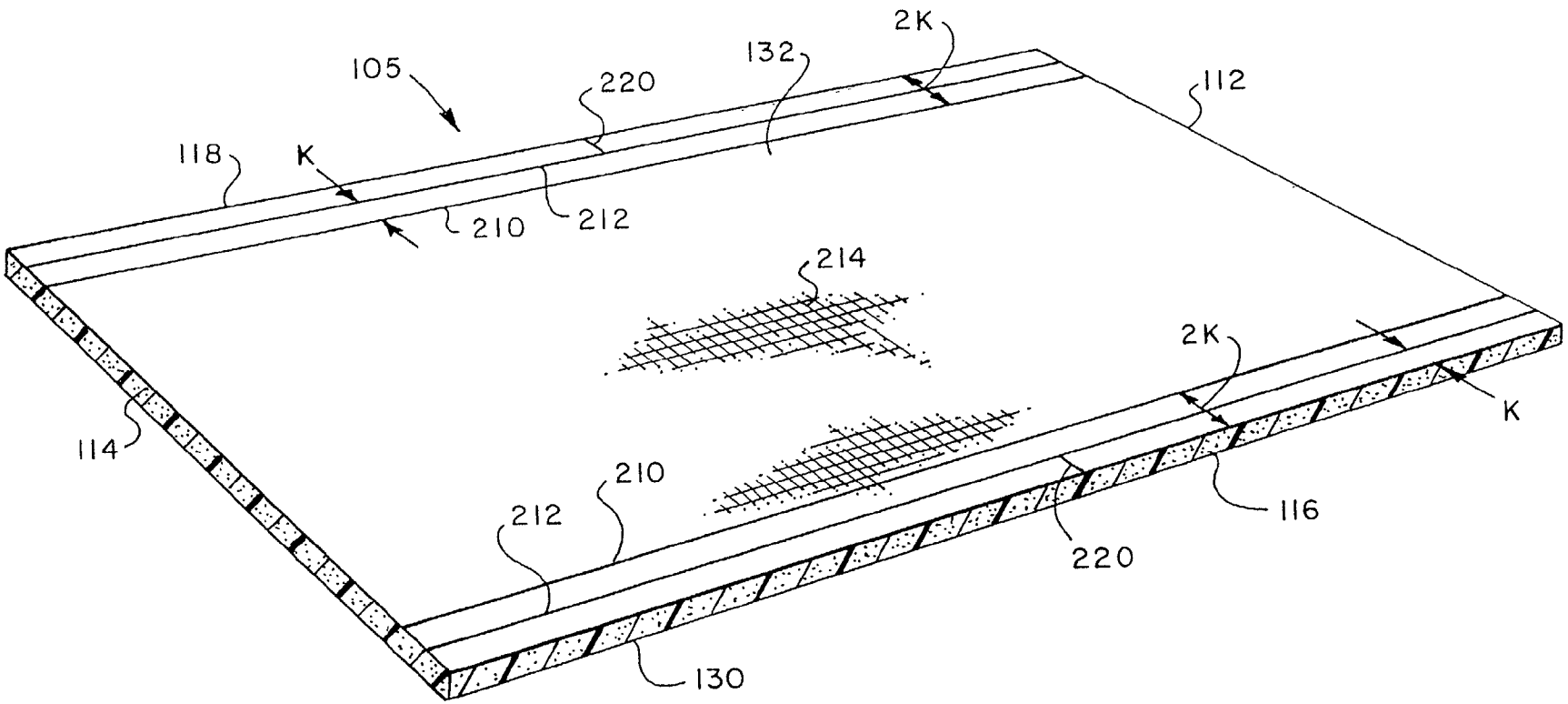
FIG. 3 is a perspective view of a flexible jacket covering.
Figure 4:
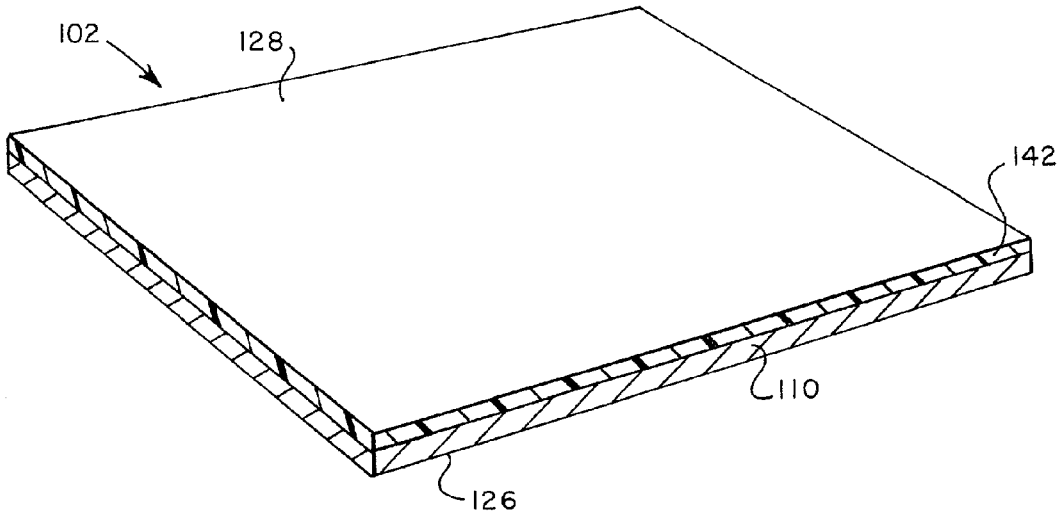
FIG. 4 is a perspective view of a cylinder base cover.
Figure 5:
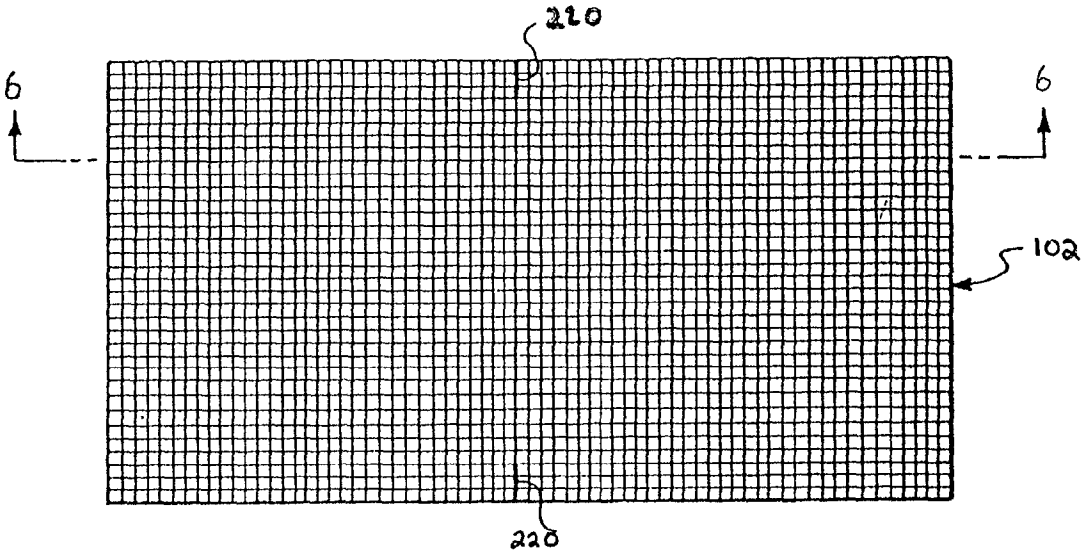
FIG. 5 is a top view of a cylinder base cover.
Figure 6:
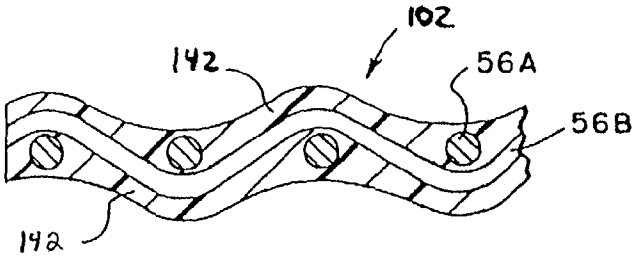
FIG. 6 is a cross-sectional view of a cylinder base cover taken along line 6—6 of FIG. 5.

FIG. 1A shows an integrated, anti-marking cover 100 for a transfer cylinder in a rotary printing press, comprising a flexible jacket covering 105 permanently attached to a cylinder base cover 102, the cylinder base cover preferably further comprising a base layer 110 and one or more top layers 142. As used herein, the term "permanently attached" means that the flexible jacket covering and cylinder base cover, where so attached, do not separate without damaging one or the other. A test for permanent attachment is subjecting the integrated cover to a separation force applied by a person, more specifically holding the flexible jacket covering portion of the integrated cover in one hand, holding the base cover portion in the other hand, and pulling the two portions in opposite directions. Referring to FIGS. 1A and 4, the cylinder base cover 102 has a bottom surface 126 for contact with a transfer cylinder and a top surface 128. Referring to FIGS. 1A and 3, the flexible jacket covering has a bottom surface 130 in contact with the top surface 128 of cylinder base cover 102 and a top surface 132 for contact with a processed substrate. The integrated cover 100, and likewise the flexible jacket covering 105 and cylinder base cover 102, each has an operator edge 114 opposing a gear edge 112 and a gripper edge 116 opposing a tail edge 118. Arrow 120 indicates the weft direction (also referred to as the transverse or fill direction), and arrow 122 indicates the warp direction (also referred to as the machine direction). The respective edges and the weft and warp directions of the integrated cover 100 and components thereof are further detailed in FIGS. 1B and 1C. The integrated cover may be produced in a variety of sizes and shapes, most often corresponding to the dimensions of the wide variety of commercial transfer cylinders available. The integrated cover is typically rectangular in shape, with the length in the warp direction greater than the length in the weft direction.

The flexible jacket covering may be permanently attached to the cylinder base cover in a variety of configurations selected and combined from independent variables including a) the attached surfaces; b) the means used for attachment; c) the extent of attachment; and d) the jacket/cover size, shape, and alignment. The integrated cover may be configured uniformly throughout (for example, the flexible jacket covering aligned flush with the cylinder base cover at all four edges and stitched along substantially the entire length of all four edges) or may differ at various locations (for example, the flexible jacket covering aligned flush with and stitched to the cylinder base cover along substantially the entire length of the gripper side edge, wrapped-around and glued to the bottom surface of the base cover along substantially the entire length of the tail side edge, and loose at the gear and operator side edges).

As for the attached surfaces, preferably the flexible jacket covering and the cylinder base cover are permanently attached along their edges, more preferably along at least two opposing edges selected from the edges 112, 114, 116, and 118, and most preferably along all four of the edges 112, 114, 116, and 118. Where less than all four edges are permanently attached, the edges not permanently attached may be left loose or releasably attached, provided that such does not interfere with operation of the transfer cylinder and/or printing press upon installation of the integrated cover. Where one or two edges are not permanently attached, preferably such edges are selected from the operator edge 114, the gear edge 112, or both. Where only one edge is permanently attached, preferably such edge is the gripper edge 116 or the tail edge 118, and most preferably the gripper edge 116. In an alternative embodiment, the flexible jacket covering and the cylinder base cover are permanently attached at their corners with the remainder of the edges loose or releasably attached. Preferably at least two corners are permanently attached, and more preferably all four corners are permanently attached. Where only two corners are permanently attached, preferably the two corners terminate the tail edge, and most preferably the two corners terminate the gripper edge.

Any suitable means for permanently attaching the flexible jacket covering to the cylinder base cover may be used such as adhesive, stitching, fasteners, and the like, and combinations thereof, provided that the permanent attachment means are configured not to interfere with the installation or operation of the integrated cover on a transfer cylinder. The permanent attachment means may be integral with the flexible jacket covering, the base cover, or both (for example, a permanent adhesive co-produced and integral with the base cover or an integral fastener having a male end on the flexible jacket covering or the base cover and a receiving female end on the other); may be an additional layer such as an adhesive layer or strip applied to one or both of the flexible jacket covering or the base cover; or may a mechanical linkage holding the flexible jacket covering and the base cover together such as stitching or a crimp strip along an edge. Any suitable adhesive may be used that is compatible with the flexible jacket covering and base cover materials and that forms a permanent bond there between. A preferred adhesive is heat set tape such as Thermo-Bond Film 669 available from 3M Corporation, which is a three layer bonding tape of a polyester film core coated on one side with a heat activated adhesive and on the other side with a high tack pressure sensitive adhesive. The heat set tape is typically about ¼ to ⅝ inches (6.4 to 15.9 mm) in width. The flexible jacket covering may be stitched to the base cover, and in one embodiment in combination with the heat set tape. Any suitable thread and stitching pattern may be used that is compatible with the flexible jacket covering and base cover materials and that forms a permanent attachment there between. A preferred thread is nylon or cotton thread of about 25 to 60 denier weight, and preferred stitching includes one or more rows of chain stitching positioned parallel to one another. Mechanical fasteners such as brads; rivets; crimp, adhesive, or tension strips (i.e., thin strips having opposing sides forming a channel for receiving an edge and holding same by crimp, adhesive, tension, or combinations thereof); staples; and the like may be used. Such fasteners may be made out of any suitable material such as plastic, metal, fabric, or combinations thereof, and are preferably thin and flexible such that they do not interfere with the installation or operation of the integrated cover on a transfer cylinder.

The extent of attachment, i.e., the total amount or percentage of surface area between the top surface 128 of the base cylinder cover and the bottom surface 130 of the flexible jacket covering that is permanently attached to one another (as defined by the lengths and widths of the attached surfaces), is selected to allow, in areas not permanently adhered to one another, movement of the flexible jacket covering relative to the base cover to provide effective, anti-marking support and transfer of processed substrates during printing operations. Preferably, the amount of movement of the flexible jacket covering relative to the cylinder base cover is about 1/16 to 4 inches (1.6 to 101.6 mm) in the weft direction and about 1/32 to 1 inch (0.8 to 25.4 mm) in the warp direction in response to light, smoothing hand pressure applied to the flexible jacket covering. Referring to FIG. 15, the reference letter K indicates the movability or "end play" of the flexible jacket covering 105 relative to the cylinder gripper edge 38A and the cylinder tail edge 38B. Preferably, the integrated cover 100 is attached in an operative position as shown in FIG. 15 with an equal amount of end play K, at the cylinder gripper end and at the cylinder tail end, so that the flexible jacket covering is precisely centered circumferentially as well as longitudinally over the transfer cylinder surface 38. Preferably, the flexible jacket covering and the cylinder base cover are permanently attached along substantially the entire length of each attached surface, more preferably along substantially the entire length of at least two opposing edges, and most preferably along substantially the entire length of all four of the edges 112, 114, 116, and 118. Permanently attached along substantially the entire length includes a continuous, uninterrupted connection (for example, a length of adhesive tape or stitching running the entire length of an edge) as well as spaced, interval connections (for example, spaced staples, stitches, or glue dots). The width of the attached surfaces, and in particular attached edge surfaces, is preferably less than or equal to about 1 inch (25.4 mm), more preferably less than or equal to about 0.5 inch (12.7 mm), and most preferably less than or equal to about 0.25 inch (6.4 mm).

The flexible jacket covering and the cylinder base cover may be sized, shaped, and aligned such that the flexible jacket covering and the cylinder base cover overlap slightly, underlap slightly, fold-over (i.e., wrap-around), or are substantially flush along each of the edges independently, that is each edge may have the same or different alignment (as well as the same or different permanent attachment means, extent of attachment, attached surfaces, etc., as described previously). Furthermore, the flexible jacket covering and the cylinder base cover are sized, shaped, and aligned to provide the relative movement to one another described previously, and in particular to account for tightening of the flexible jacket covering (and resulting reduction in relative movement, particularly in the weft direction) upon installation of the integrated cover on a transfer cylinder. Preferably, the flexible jacket covering and the cylinder base cover are substantially the same shape, more preferably rectangular in shape as described previously.

Figure 2A:
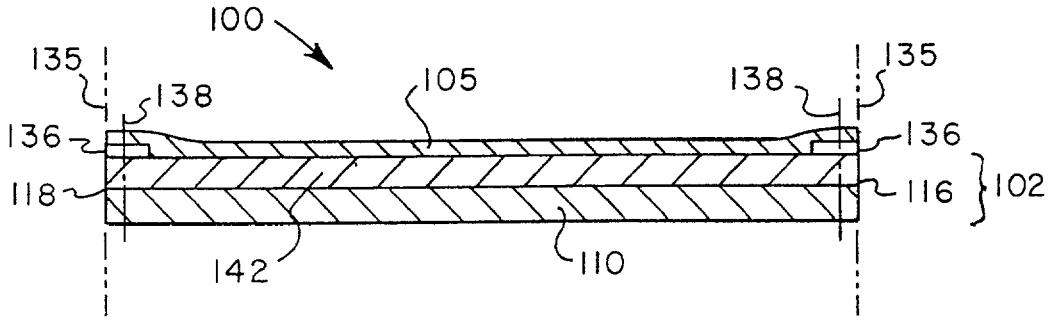
FIGS. 2A, 2B, and 2C are cross-sectional views of integrated, anti-marking covers taken along line 2—2 of FIG. 1A.
Figure 2B:
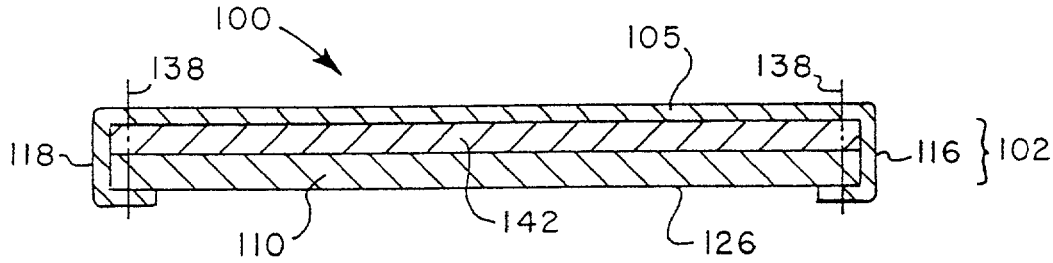
Figure 2C:
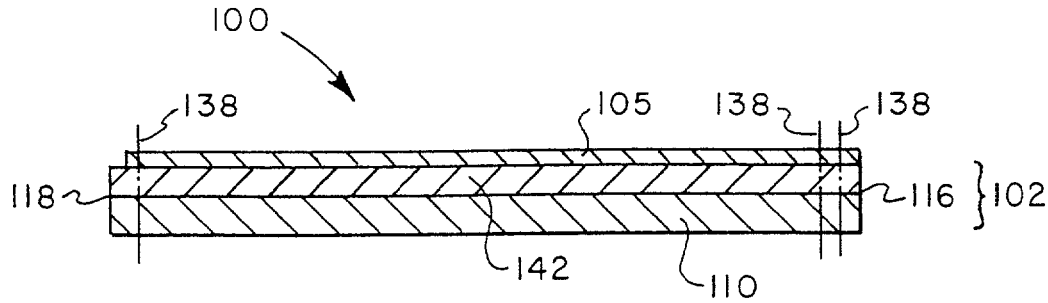

Referring to FIGS. 2A–C, which are cross-sections of an integrated base cover 100 taken along line 2—2 in the weft direction, various alternative configurations of alignment and permanent attachment means are shown for attaching the flexible jacket covering 105 to the cylinder base cover 102. Referring to FIG. 2A, the gripper edge 116 and the tail edge 118 are constructed uniformly wherein the respective, corresponding edges of the flexible jacket covering and cylinder base cover are aligned flush (as shown by dotted lines 135) and permanently attached along substantially the entire length of each edge with a strip of heat set tape 136 and a single row of stitching 138. Preferably, the stitching is located within the width of the heat set tape, and more preferably in the center of the width of the heat set tape. Referring to FIG. 2B, the gripper edge 116 and the tail edge 118 are constructed uniformly wherein the edges of the flexible jacket covering are folded over the corresponding edges of the cylinder base cover and extend to the bottom surface 126 thereof. The edges 116 and 118 of the flexible jacket covering and cylinder base cover are permanently attached along substantially their entire length by a single row of stitching 138. Referring to FIG. 2C, the gripper edge 116 and the tail edge 118 are constructed differently, wherein the edges of the flexible jacket covering and the cylinder base cover are flush at the gripper edge 116 and the flexible jacket covering is slightly underlapped at the tail edge 118. The edges 116 and 118 of the flexible jacket covering and cylinder base cover are permanently attached along substantially their entire length by a single row of stitching 138 on the tail edge 118 and by a dual row of stitching 138 on the gripper edge 116. The embodiments of FIGS. 2A—C are exemplary, and other alternative configurations will be readily apparent to those skilled in the art based upon the description herein.

The flexible jacket covering may be made from any material suitable for permanent attachment to the cylinder base cover and providing effective, anti-marking support and transfer of processed substrates during printing operations. The flexible jacket covering may comprise a fabric, for example a natural material such as cotton, hemp, wool, silk, linen, and the like or a synthetic material such as nylon, rayon, polyesters, polyacrylates, polyolefins, polyimides, polyamides, and the like. The fabric may be woven or non woven, and a preferred fabric is a loosely woven, lightweight cotton material such as gauze or cheesecloth having about a forty mesh and weave of about 28 warp×32 weft (fill). The flexible jacket covering may be treated with fabric softeners, fabric protectors, anti-static compounds, and the like to help reduce ink buildup thereon. A preferred fabric treatment is Scotchguard available from 3M Corporation. In a preferred embodiment, the flexible jacket covering is conductive. As used herein, the term conductive means that the material is capable of dissipating an electrostatic charge through contact with a grounded object, for example passing electrostatic charges from the printed substrate to the cylinder base cover and/or the transfer cylinder to a grounded press frame. The electrical resistivity of a preferred conductive material at room temperature (70° F.; 21° C.) is in the range $10^{-2}$ ohms-centimeter to $10^{9}$ ohms-centimeter, which is between the resistivity of metals and insulators. The flexible jacket may be made conductive, for example, by treatment with a conductive means or by weaving one or more conductive strands or threads spaced in the weft and/or warp directions. In an embodiment of the flexible jacket covering 105 shown in FIG. 3, the conductive strands designated 210 and 212 run in the warp direction.

In one embodiment, conductivity of the strands or threads is obtained by impregnating or otherwise treating the strands or threads with an aqueous solution of an anti-static ionic polymer compound selected from the group including ammonium salts, polyglycerol esters and sorbitan esters. That is, the flexible jacket covering 105 is treated by soaking the flexible jacket covering in an aqueous solution of an anti-static ionic polymer compound, or by spraying the aqueous solution of anti-static ionic polymer compound onto the flexible jacket covering, or by impregnating the threads or strands with the aqueous anti-static ionic compound prior to weaving. In another embodiment, the strands are rendered conductive by applying a conductive fluropolymer resin coating on each strand. In another embodiment, the flexible jacket covering can be constructed entirely of natural threads, strands or fibers, and can be rendered conductive by impregnating the woven material with an ionic polymer selected from the group including polyacrylic acid polymers and polyammonium polymers. In another embodiment, the flexible jacket covering can be rendered conductive by forming at least one or more of the strands of a conductive metal wire, for example a bare copper filament. As previously discussed, the conductive elements of the flexible jacket covering are preferably uniformly distributed throughout the body of the flexible jacket covering.

In an embodiment, the fabric material is pre-stretched so that it substantially resists elongation in response to a tension force applied to the flexible jacket covering by smoothing hand pressure with its elastic recovery being less than about two percent (2%) of its relaxed length in response to tension induced by light, smoothing hand pressure applied to the jacket covering. Preferably, the flexible fabric material has an ASTM Strength and Elongation rating (for a one inch by six inch sample) that does not exceed about six percent (6%) in weft elongation, with breakage occurring in weft at about seven percent (7%) elongation, and does not exceed about eleven percent (11%) in warp elongation, with breakage occurring in warp at about twelve percent (12%) elongation.

In an embodiment, the integrated cover comprises means for aligning the integrated cover for attachment to the transfer cylinder. Referring to FIG. 3, the flexible jacket covering may include one or more alignment stripes 210 and 212 and one or more center alignment marks 220 for easily and precisely securing the flexible jacket covering over and in alignment with the gripper edge and the tail edge of a transfer cylinder. Preferably a center alignment mark 220 is positioned in the center of the gripper edge 116, tail edge 118, or both. Preferably, at least one warp strand 210 has a color that contrasts with the color of the remaining weave, thereby defining at least one contrasting stripe. For example, multiple black strands 210 and 212 are interwoven, thereby defining black alignment stripes 210 and 212 at least at the gripper edge and the tail edge of the flexible jacket covering 105. Preferably, a plurality of contrasting stripes 210 and 212 (which run in the warp direction) are spaced across the entire length of the flexible jacket covering in the weft direction. In an embodiment, a portion or all the contrasting alignment stripes are made conductive as described previously. Strands or threads having another contrasting color, such as blue, are also interwoven to define a blue background field having lattice pattern 214. Moreover, the black alignment stripes 210 and 212 are separated by a spacing distance, preferably by distance K corresponding to the amount of movement or end play of the flexible jacket covering at the gripper and tail edges of the transfer cylinder, as described previously and shown in FIG. 15. The spacing distance K in an exemplary embodiment is about ¾ inch (19.1 mm). Other spacing distances can be utilized depending upon the desired amount of relative movement between the flexible jacket covering and the cylinder base cover. The lattice pattern 214 preferably is of a checkerboard design, but other designs such as herringbone or the like can be used to good advantage. In the embodiment of FIG. 3, the strands are woven in a rectangular grid lattice pattern, with the spacing distance between adjacent strands being at least ten times the diameter of either adjacent strand, thereby defining an open grid pattern. In another embodiment, contrasting stripes running in the warp direction are provided alone or in combination with contrasting stripes running in the weft direction. In another embodiment, more than one color may be used for the alignment stripes (for example, black alignment stripes alternating with white alignment stripes). It will be appreciated that the provision of means for aligning the integrated cover such as contrasting stripes and center alignment marks are preferred for ease of attachment and alignment of the integrated cover on the transfer cylinder, but are not strictly necessary for the successful practice of the invention. Other embodiments of flexible jacket coverings useful in practicing the present invention are disclosed in U.S. Pat. Nos. 5,907,998; 5,979,322; 6,119,597; and 6,244,178, referenced previously.

The cylinder base cover may be made from any material suitable for permanent attachment to the flexible jacket covering and for contact with and releasable attachment to a transfer cylinder. Preferably, the cylinder base cover has a low friction top surface 128 for contact with the flexible jacket covering and is conductive for passing electrostatic charges from the processed substrate and/or the flexible jacket covering to the transfer cylinder. Referring to FIG. 4, the cylinder base cover 102 comprises a base layer 110 (also referred to herein as a carrier sheet) and one or more additional top layers 142, which may be films or coatings and preferably are conductive compounds. A preferred top layer is a coating of a fluoropolymer such as fluorinated ethylene propylene (FEP) resin or a polytetrafluoroethylene (PTFE) resin, for example sold under the trademarks TEFLON available from DuPont Corporation and XYLAN available from Whitford Corporation. Preferably, the fluoropolymer resin further comprises a conductive material such as carbon black, graphite, or the like. The low friction top surface 128 may be smooth, or alternatively may be rough or textured to further reduce the area in contact with the flexible jacket covering. Preferably, the low friction top surface 128 has frictional coefficient that is less than the frictional coefficient of the bare transfer cylinder support surface. The frictional coefficient may be further reduced by radially projecting surface portions on top surface 128, or by openings or holes formed in the cylinder base cover, that reduce the surface area in frictional engagement between the flexible jacket covering and the cylinder base cover. The radially projecting surface portions may be provided by weft and/or warp strands of woven materials, nodes, beads, and combinations thereof.

The base layer may comprise natural material such as cotton, hemp, wool, silk, linen, and the like and/or a synthetic material, including cellulosic fiber such as rayon; linear polyamides such as nylon; linear polyesters such as polyethylene terephthlate sold under the trade name MYLAR; hydrocarbon or halogenated hydrocarbon resins such as polyethylene, polypropylene or ethylene-propylene copolymers; aramid and polyaramids such as those sold under the trade names KEVLAR and NOMEX; and acrylonitrile butadinene styrene (ABS). These base layer materials may be sheets, films, webs (both woven and non-woven) and the like, preferably have a low coefficient of friction surface, and may be combined with a conductive agent, such as carbon black, graphite or the like, to render the base layer material conductive. In a preferred embodiment, the base layer has a finished thickness in the range of about 0.004 to 0.020 inches (0.1 to 0.5 mm). These base layer materials may optionally be used in combination with one or more additional layers (i.e., top layer 142), for example a layer or coating of PTFE. In a preferred embodiment, the cylinder base cover 102 is a laminate of a base layer 110 comprising Mylar and bonded thereto a top layer 142 comprising PTFE and carbon black, such laminates are sold under the trade name CHEMLAM RLPR400 available from St. Gobain Corporation.

As used herein, "fluoropolymer" means and refers to fluorocarbon polymers, for example polytetrafluoroethylene, polymers of chlorotrifluoroethylene, fluorinated ethylenepropylene polymers, polyvinylidene fluoride, hexafluoropropylene, and other elastomeric high polymers containing fluorene, also known and referred to as fluoroelastomers. The fluoropolymer resins preferably contain electrically conductive carbon black, or some other equivalent conductive agent such as graphite or the like, preferably in an amount sufficient to provide a surface resistivity not exceeding approximately 100,000 ohms/square. In a preferred embodiment, the surface resistivity of the conductive cylinder base cover does not exceed approximately 75,000 ohms per square. Other surface resistivity values may be used to good advantage, for example in the surface resistivity range of 50,000 ohms per square to 100,000 ohms per square. The coefficient of friction and conductivity of the cylinder base cover are influenced by the amount of the conductive agent present in the conductive compound. Consequently, the amount of conductive agent included in the fluoropolymer resin for a given conductivity or surface resistivity will necessarily involve a compromise with the coefficient of friction. Generally, high conductivity (low surface resistivity) and low coefficient of friction are desired. Preferably the amount of conductive agent contained in the fluoropolymer resin is selected to provide a surface resistivity not exceeding approximately 75,000 ohms/square and a coefficient of friction not exceeding approximately 0.110.

Referring to FIGS. 5–12, various alternative configurations of cylinder base cover 102 are shown. In an embodiment shown in FIGS. 5 and 6, the base layer is a fabric (comprising natural fibers, synthetic fibers, or both), such as a woven material having warp strands 56A and weft strands 56B, and a coating 142 of a conductive compound such as FEP or PTFE resin. The warp and weft (fill) strands comprise fiberglass, polyamide, or both, woven together in a base fiber thickness of about 0.007 inch (0.2 mm). The woven material is coated with conductive PTFE resin to a finished thickness in the range of about 0.004 to 0.020 inches (0.1 to 0.5 mm), a finished weight in the range of 17–20 ounces per square yard (56–63 dynes/sq.cm.), with a tensile strength of approximately 400×250 warp and weft (fill) pounds per square inch ($281\times10^3$–$175\times10^3$ kg/sqm).

Referring to FIG. 4, the low friction, conductive cylinder base cover 102 in another embodiment comprises a metal foil carrier sheet 110, constructed of a malleable metal such as aluminum, copper, zinc or the like. The surface of the conductive carrier sheet 140 is covered by a layer 142 of a fluoropolymer resin that contains a conductive agent, for example polytetrafluoroethylene resin (PTFE) containing carbon black, as previously specified.

Figure 7:
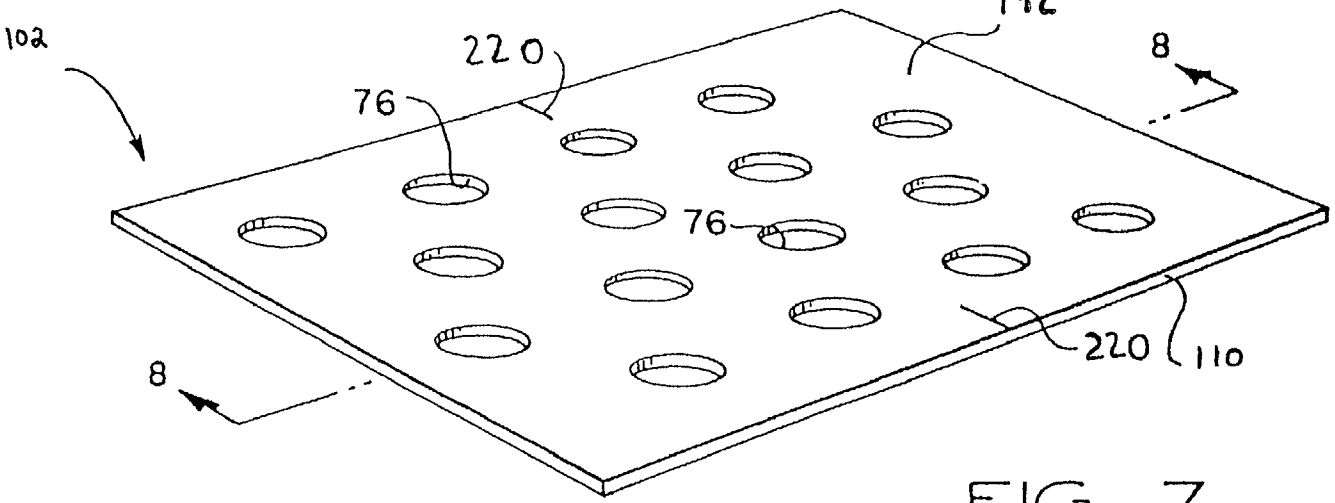
FIG. 7 is a perspective view of a cylinder base cover.
Figure 8:
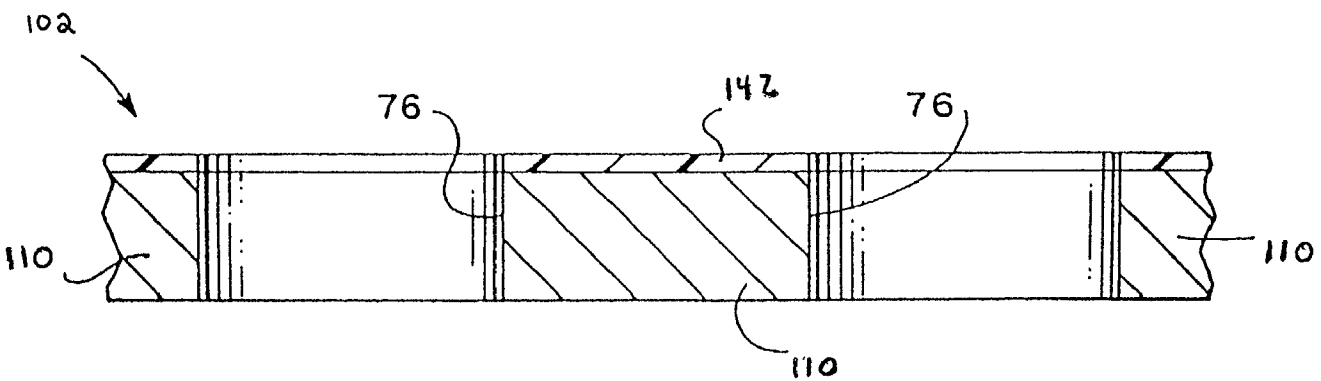
FIG. 8 is a cross-sectional view of a cylinder base cover taken along line 8—8 of FIG. 7.

In another embodiment shown in FIG. 7 and FIG. 8, a low friction, conductive cylinder base cover 102 includes a base carrier sheet 110 and a low friction, conductive coating layer 142 that are completely intersected by multiple bores or openings 76. The purpose of the bores or openings 76 is to reduce the surface area for contact with the flexible, ink repellent conductive jacket covering 105, thereby further reducing the frictional drag between the conductive cylinder base cover 102 and the flexible jacket covering.

Figure 9:
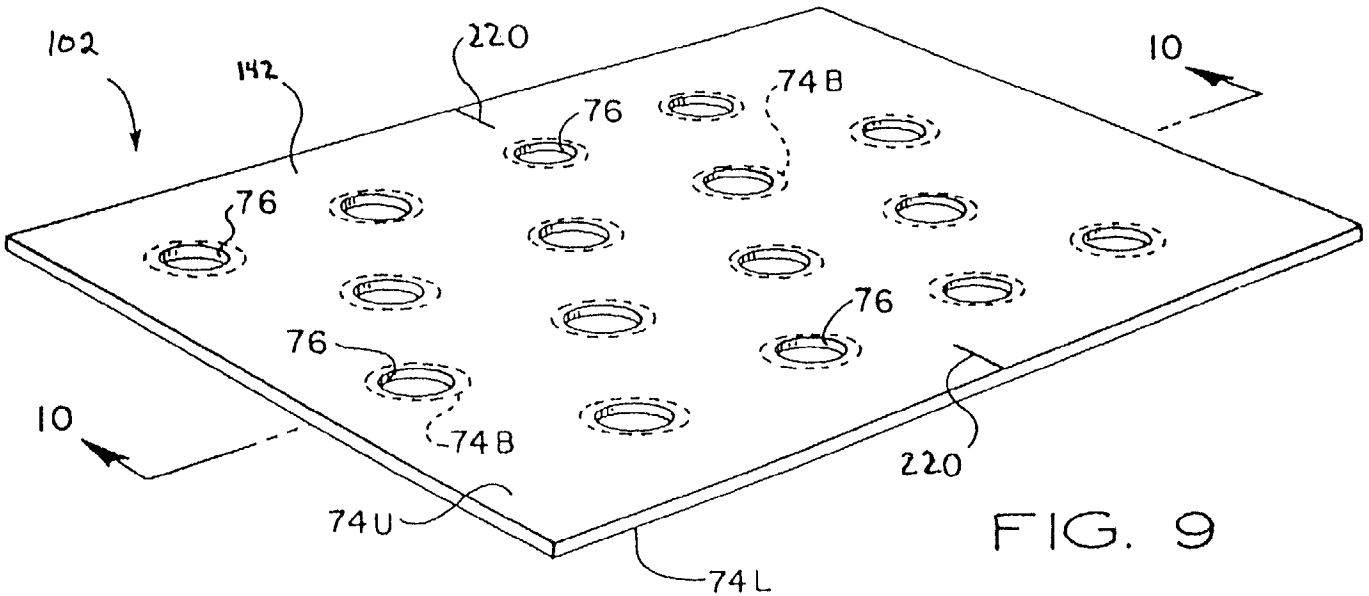
FIG. 9 is a perspective view of a cylinder base cover.
Figure 10:
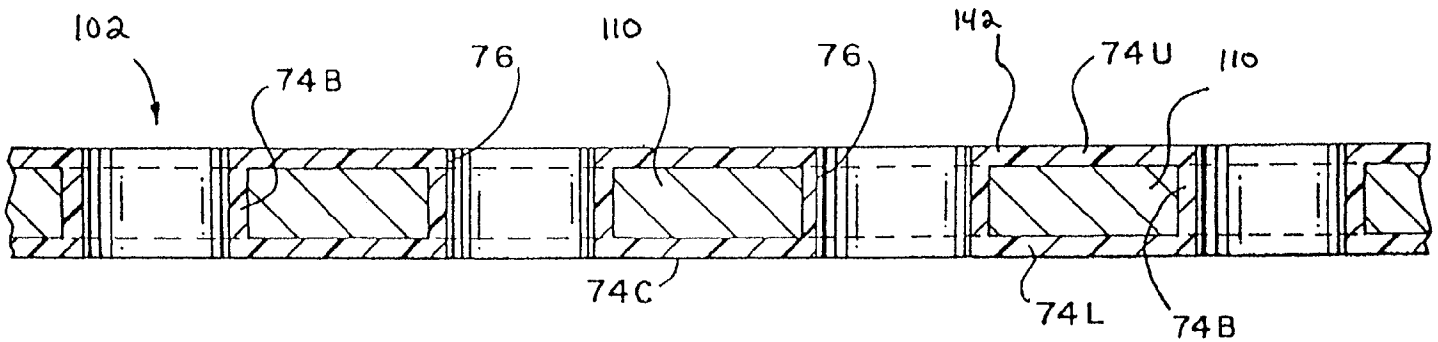
FIG. 10 is a cross-sectional view of a cylinder base cover taken along line 10—10 of FIG. 9.

Referring to FIG. 9 and FIG. 10, an alternative cylinder base cover 102 is illustrated in which the same metal foil carrier sheet 110 is covered on both sides with the low friction, conductive coating material 142, with the low friction conductive material 142 extending through the openings 76 and thereby forming a conductive bridge 74B between the upper coating layer 74U and lower coating layer 74L and the cylinder engaging surface 74C. According to this arrangement, a good electrical connection is made between the external surface 38 of the transfer cylinder and the ink repellent, conductive flexible jacket covering.

Figure 11:
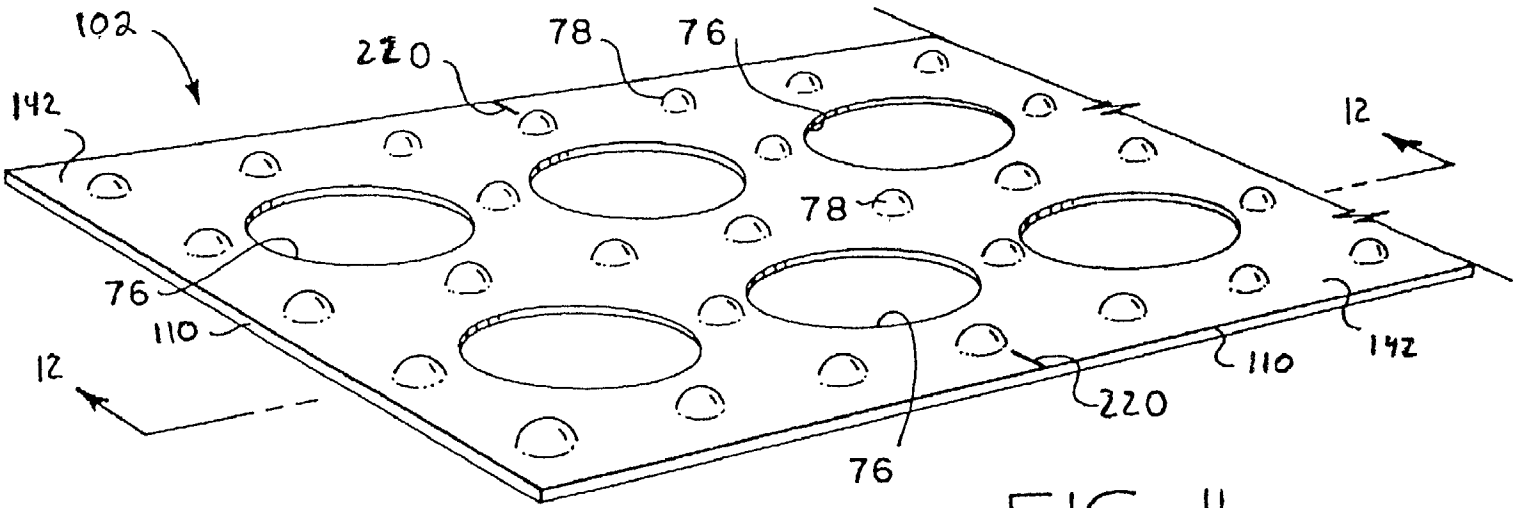
FIG. 11 is a perspective view of a cylinder base cover.
Figure 12:
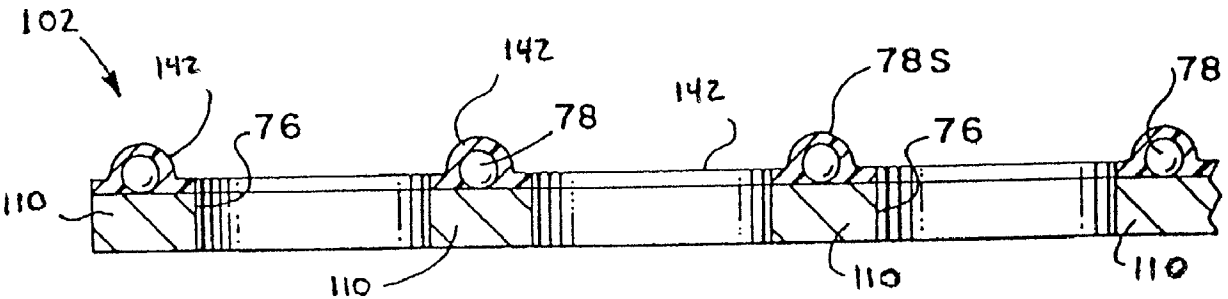
FIG. 12 is a cross-sectional view of a cylinder base cover taken along line 12—12 of FIG. 11.

Referring now to FIGS. 11 and 12, an alternative embodiment of a conductive, low friction cylinder base cover 102 is illustrated. In this alternative embodiment, a cylinder base cover 102 includes a carrier sheet 110 formed of a foil or thin sheet of metal such as aluminum, copper, or stainless steel comprising (in addition to the opening described previously) multiple nodes or radial projections 78 disposed on the engaging side of the carrier sheet 110. Each node 78 has a curved substrate engageable surface 78S, which is aligned with the curved transfer path of the processed substrate. Preferably, the nodes 78 and the surface of the carrier sheet 110 are covered by a layer 142 of a conductive, low friction resin compound, for example, a fluoropolymer impregnated with a conductive agent such as carbon black, graphite, or the like. Polytetrafluoroethylene (PTFE) impregnated with carbon black is preferred for this embodiment, and is applied in a layer directly onto the surface of the carrier sheet 110 as previously described. The carrier sheet 110 should have a gauge thickness that is sufficient to provide strength and dimensional stability and yet be flexible enough to be easily secured around the transfer cylinder 34. The gauge thickness of the conductive carrier sheet 110 is in the range of approximately 2 mils (0.05 mm) to approximately 24 mils (0.6 mm), depending on press clearance and design. Preferably, the coated beads 78 are arranged in a rectilinear grid pattern and are circumferentially spaced from the adjacent openings 76 by approximately 3 mils (0.07 mm). Upon installation of the integrated cover, the carrier sheet 110 is in direct, electrical contact with the supporting surface of the transfer cylinder. The low friction, conductive coating 142 is formed directly on the carrier sheet, whereby electrostatic charges delivered by a freshly processed substrate to the ink repellent, flexible conductive jacket covering are conducted away from the flexible jacket covering and are conducted through the carrier sheet 110 into the transfer cylinder body and discharged into the grounded printing press frame.

The embodiments of the cylinder base cover 102 shown in FIGS. 5—12 are exemplary, and other alternative configurations will be readily apparent to those skilled in the art based upon the description herein. Other embodiments of cylinder base covers useful in practicing the present invention are disclosed in U.S. Pat. Nos. 5,511,480; 5,603,264; 6,073,556; and 6,192,800, referenced previously. The previously described embodiments of the cylinder base cover are each effective for reducing the amount of surface for contact with the flexible jacket covering. For example, the overlapping warp and weft (fill) strands 56A, 56B of the woven embodiment (FIGS. 5, 6) provide a lattice-like framework of radially projecting portions that reduce the surface area for frictional engagement by the ink repellent, conductive flexible jacket covering. In the node embodiment (FIGS. 11 and 12), the radially projecting, curved configuration of the nodes 78 and the node spacing provide reduced surface area contact between the flexible, ink repellent conductive jacket covering and the low friction, conductive cylinder base cover 102. The bores or openings 76 in FIGS. 7–10 reduce the surface area for contact with the flexible, ink repellent conductive jacket covering 105, thereby further reducing the frictional drag between the conductive cylinder base cover 102 and the flexible jacket covering. An additional advantage provided by the foregoing low friction, conductive base cylinder embodiments is that the structurally differentiated and radially projecting surface portions provided by the woven material and by the nodes concentrate or focus the area of electrostatic discharge between the conductive, ink repellent flexible jacket covering and the low friction, conductive cylinder base covering. The raised or projecting surfaces associated with the woven material and the nodes provide reduced area discharge points or electrostatic precipitation points where the electric field intensity is increased, thus enhancing the conduction or transfer of electrostatic charges from the flexible, ink repellent and anti-static jacket covering 105 to the low frictional conductive cylinder base covering and into the cylinder 34 and the grounded press frame 14. Consequently, static clinging is completely eliminated and the force of frictional engagement is substantially reduced, thus permitting completely free movement of the ink repellent, conductive flexible jacket covering relative to the low friction, conductive cylinder base cover 102. Free movement between the flexible jacket covering and the cylinder base cover helps reduce ink marking in high-speed printing presses and eliminate depressions and indentations in the freshly printed substrates. Additionally, the reduced frictional engagement results in a longer service life for the integrated cover.

The present invention further provides a method of manufacturing an integrated, anti-marking cover for a transfer cylinder in a rotary printing press, comprising permanently attaching a flexible jacket covering to a cylinder base cover. The method of manufacture further comprises selecting an integrated cover from the embodiments described herein, providing a cylinder base cover and a flexible jacket covering each having a structure and physical properties conforming to the selected integrated cover, providing a means for permanently attaching the flexible jacket covering to the cylinder base cover as described herein, aligning the flexible jacket covering and cylinder base cover to conform to the selected integrated cover, and permanently attaching the flexible jacket covering to the cylinder base cover with the means for permanent attachment. The integrated cover may optionally be trimmed for sizing or to remove any excess material. The permanent attachment is carried out as would be known to a person skilled in the art in accordance with the selected means for permanent attachment, for example stitching is provided by a sewing machine; heat set adhesive may be provided by a hot glue gun or a heat set tape in combination with a heating press; and so on. Preferably the flexible jacket covering and cylinder base cover are provided pre-cut and pre-sized, provided however that either or both may be provided in bulk form (for example, as roll of material) and sized and cut during the manufacturing process. The manufacturing steps may be automated or performed manually, and the sequence of the steps may be varied to provide for the numerous structural configurations of the integrated cover as described herein. For example, the alignment and permanent attachment steps may be alternated with the assembly of each edge, which is useful in controlling the amount of movement of the flexible jacket covering relative to the cylinder base cover, as described previously. A method of manufacturing a preferred embodiment is provided in the Example below.

Figure 13A:
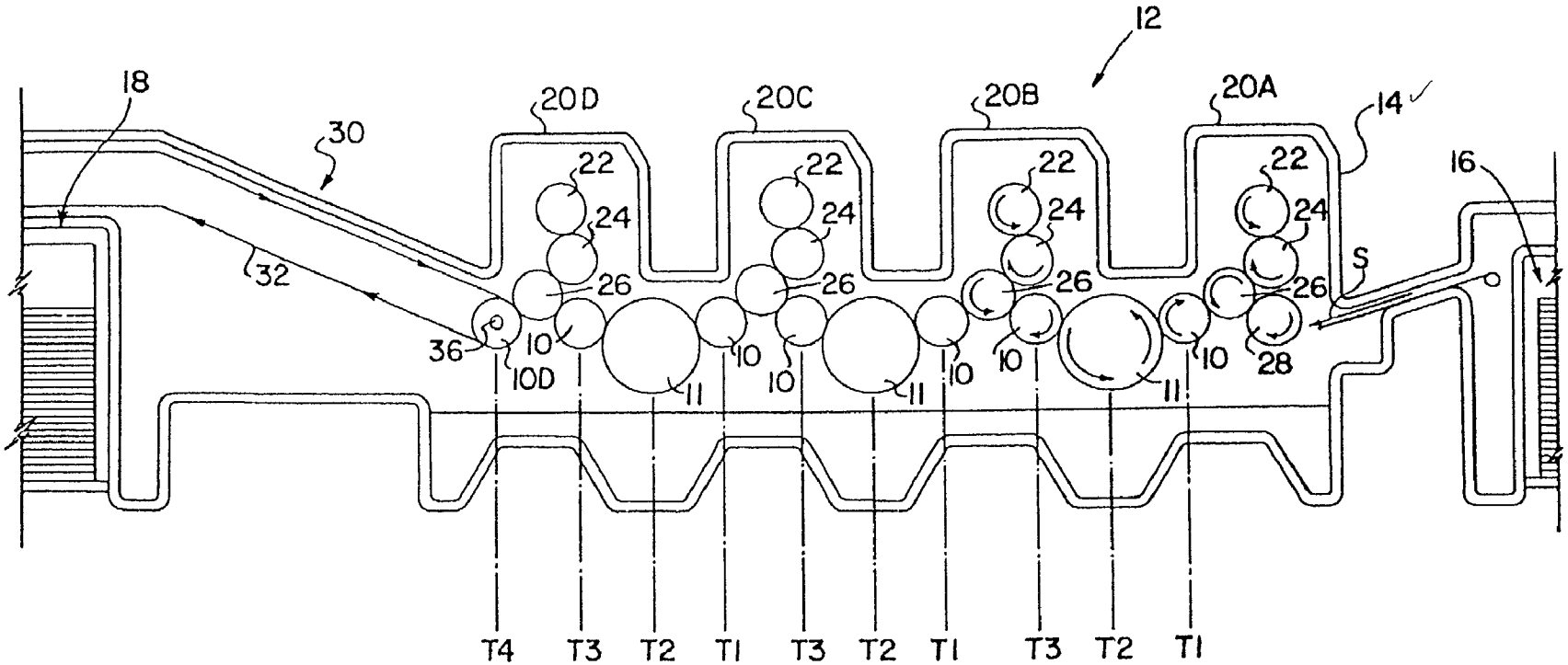
FIG. 13A is a schematic side elevational view showing multiple transfer cylinders installed at substrate transfer positions in a four color rotary offset printing press of a type made by Heidelberg Druckmaschinen Aktiengesellschaft.
Figure 13B:
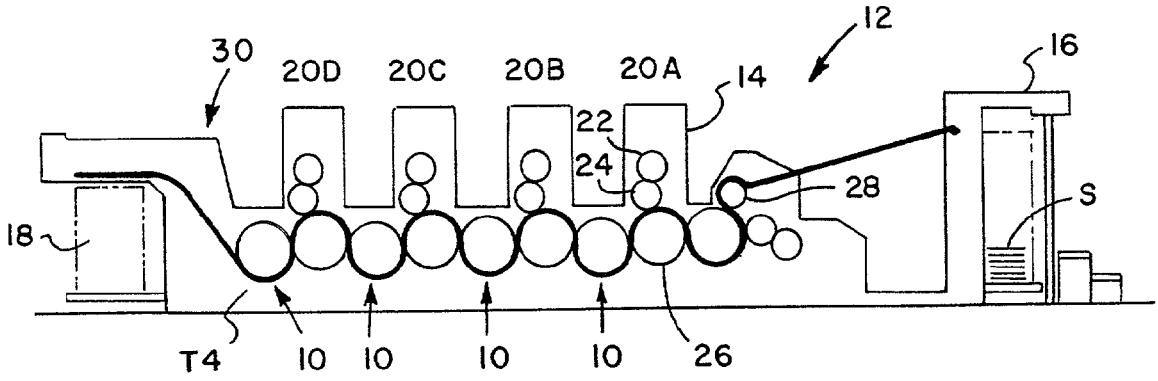
FIG. 13B is a schematic side elevational view showing multiple transfer cylinders installed at substrate transfer positions in a four color rotary offset printing press of the Lithrone Series made by Komori Corp.

For exemplary purposes, the invention will be described with reference to the processing of sheet substrates. However, it will be understood that the principles of the invention are equally applicable to web substrates. The integrated cover of the present invention may be used in combination with high-speed printing press equipment of the type used, for example, in offset printing. FIG. 13A shows a typical, four color offset printing press of the type made by Heidelberg Druckmaschinen Aktiengesellschaft, and FIG. 13B shows a four color offset printing press of the Lithrone Series available from Komori Corp. Referring to FIGS. 13A and 13B, such equipment includes one or more transfer cylinders 10 for handling a processed substrate such as a freshly printed sheet between printing units and upon delivery of the printed sheet to a delivery stacker. The integrated cover of the present invention is installed on one or more, and preferably all, of transfer cylinders 10. As used herein, the term "processed" refers to various printing methods, which may be applied to either side or both sides of a substrate, including the application of aqueous inks, protective coatings and decorative coatings. The term "substrate" refers to sheet material or web material.

Use of the present invention in combination with the transfer cylinder 10 at an interstation transfer position (T1, T3) or at a delivery position (T4) in a typical rotary offset printing press 12 is believed to be readily understandable to those skilled in the art. In any case, reference may be made to my earlier U.S. Pat. Nos. 3,791,644 and 4,402,267, which disclose details regarding the location and function of a sheet support cylinder in a typical multistation printing press. The present invention may, of course, be utilized with conventional printing presses having any number of printing units or stations.

Referring to FIGS. 13A and 13B, the press 12 includes a press frame 14 coupled on its input end to a sheet feeder 16 from which sheets, herein designated S, are individually and sequentially fed into the press. At its delivery end, the press 12 is coupled to a sheet stacker 18 in which the printed sheets are collected and stacked. Interposed between the sheet feeder 16 and the sheet stacker 18 are four substantially identical sheet printing units 20A, 20B, 20C, and 20D which are capable of printing different color inks onto the sheets as they are transferred through the press.

As illustrated in FIGS. 13A & 13B, each printing unit is of conventional design, and includes a plate cylinder 22, a blanket cylinder 24 and an impression cylinder 26. Freshly printed sheets S from the impression cylinder are transferred to the next printing unit by a transfer cylinder 10. The initial printing unit 20A is equipped with a sheet in-feed roller 28 which feeds individual sheets one at a time from the sheet feeder 16 to the initial impression cylinder 26.

The freshly printed sheets S are transferred to the sheet stacker 18 by a delivery conveyor system, generally designated 30. The delivery conveyor 30 is of conventional design and includes a pair of endless delivery gripper chains 32 carrying transversely disposed gripper bars, each having gripper elements for gripping the leading edge of a freshly printed sheet S as it leaves the impression cylinder 26 at the delivery position T4. As the leading edge of the printed sheet S is gripped by the grippers, the delivery chains 32 pull the gripper bars and sheet S away from the impression cylinder 26 and transport the freshly printed sheet S to the sheet delivery stacker 18.

Referring to FIG. 13A, an intermediate transfer cylinder 11 receives sheets printed on one side from the transfer cylinder 10 of the preceding printing unit. Each intermediate transfer cylinder 11, which is of conventional design, typically has a diameter twice that of the transfer cylinder 10, and is located between two transfer cylinders 10, at interstation transfer positions T1, T2 and T3, respectively. The impression cylinders 26, the intermediate transfer cylinders 11, the transfer cylinders 10, as well as the sheet in-feed roller 28, are each provided with sheet grippers which grip the leading edge of the sheet to pull the sheet around the cylinder in the direction as indicated by the associated arrows. The transfer support cylinder 10 in the delivery position T4 is not equipped with grippers, and includes instead a large longitudinal opening A, which provides clearance for passage of the chain driven delivery conveyor gripper bars.

Figure 15B:
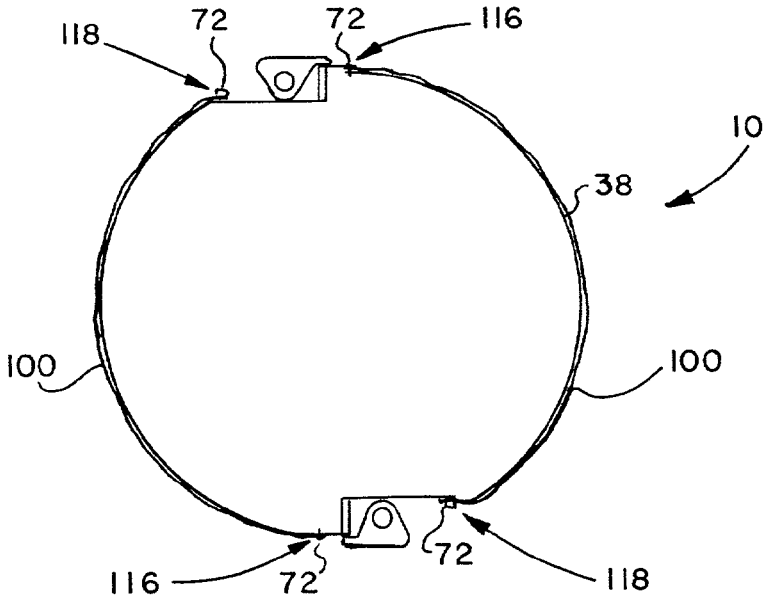
FIG. 15B is a cross-sectional view of a transfer cylinder of a type commonly used on Lithrone Series printing presses made by Komori Corp.
Figure 14:
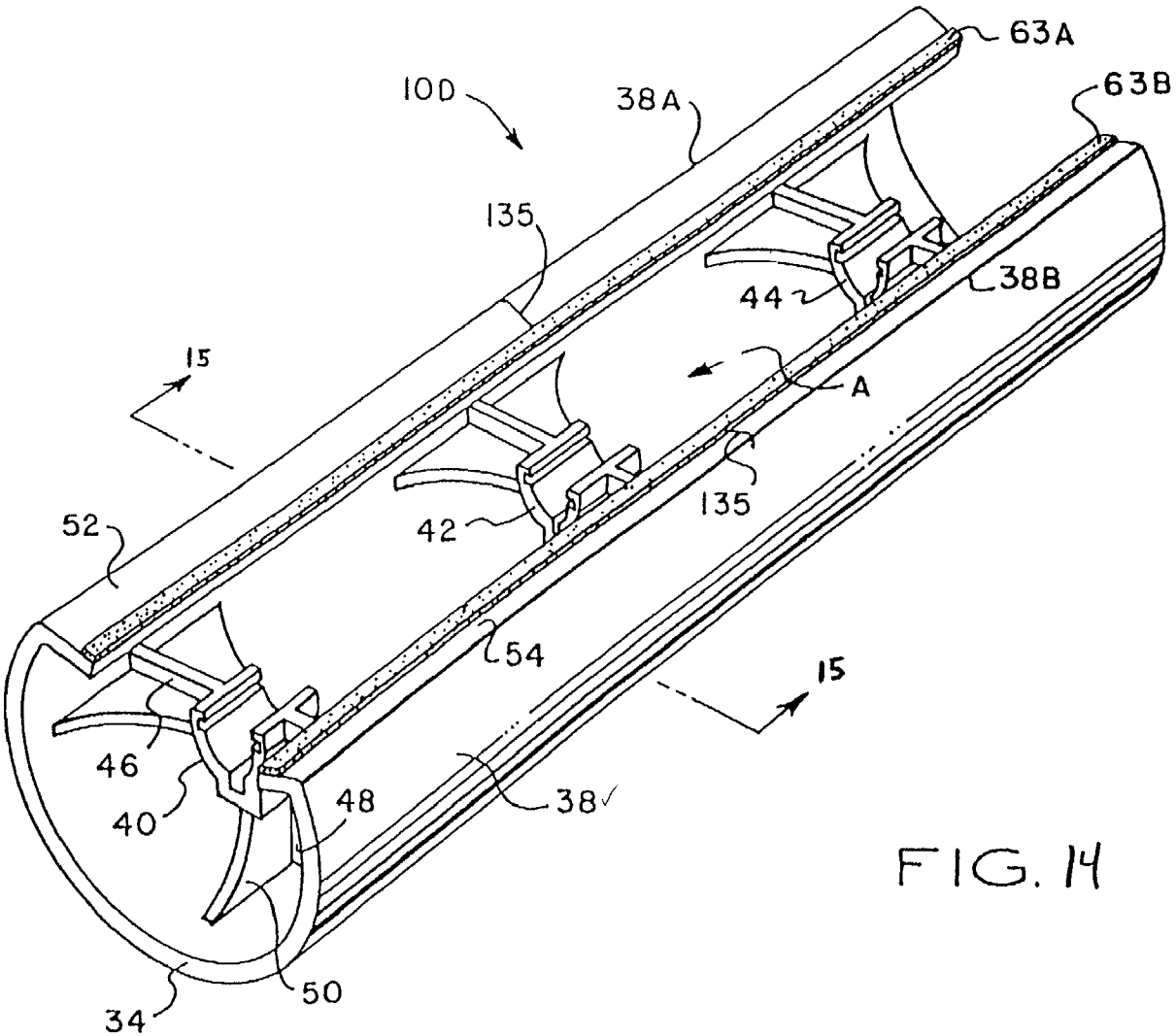
FIG. 14 is a perspective view of a transfer cylinder of a type commonly used on printing presses made by Heidelberg Druckmaschinen Aktiengesellschaft.
Figure 15A:
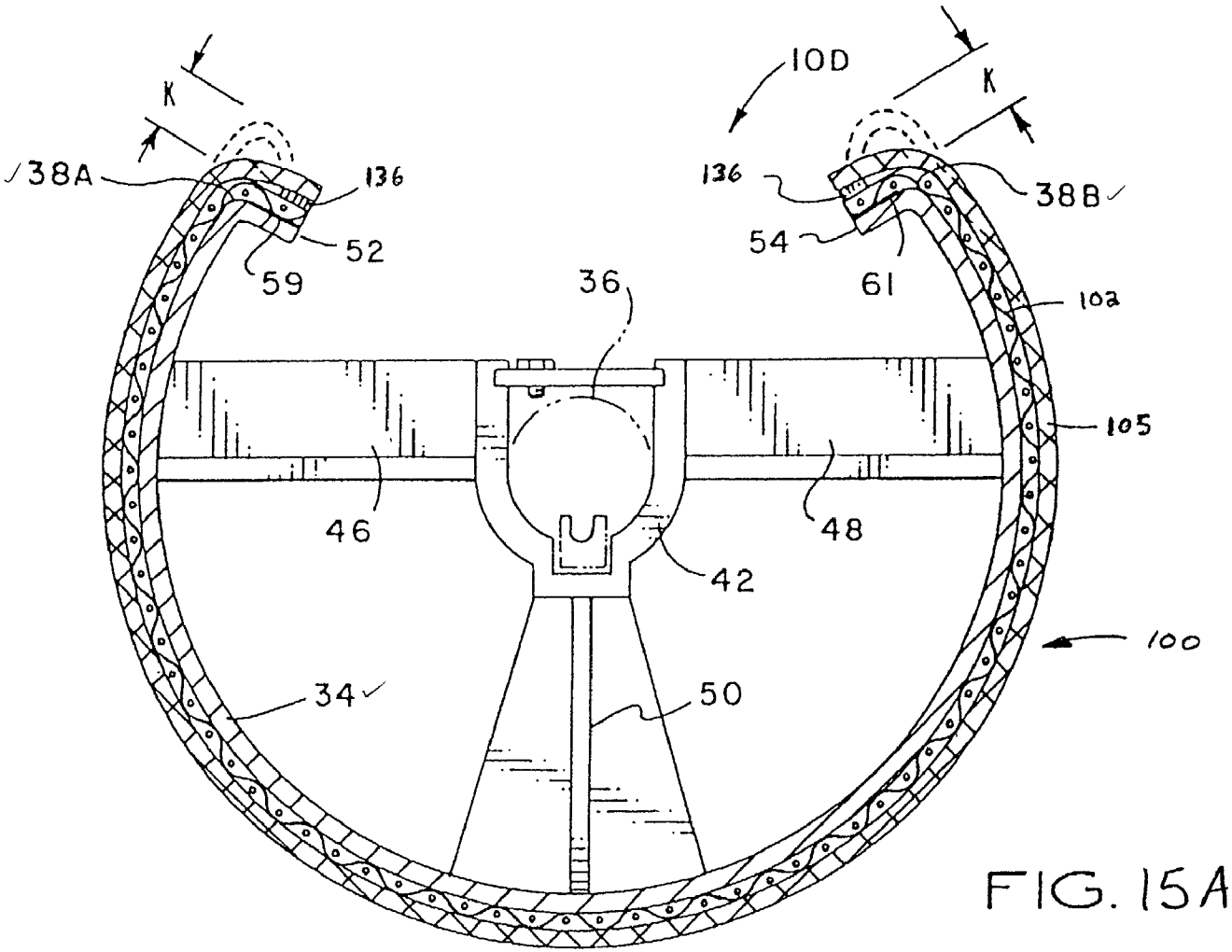
FIG. 15A is a cross-sectional view of a transfer cylinder taken along line 15—15 of FIG. 14 having an integrated, anti-marking cover installed thereon.

Referring now to FIGS. 14 and 15A, a preferred transfer cylinder is shown for use with the Heidelberg printing press of FIG. 13A. Integrated cover 100 as described herein is installed on a transfer cylinder 10D on the last printing unit 20D of the press 12 in the delivery position (T4) and has a cylindrical rim 34 which is supported for rotation on the press frame 14 by a rotatable delivery shaft 36. The external cylindrical surface 38 of the cylindrical rim 34 has a gap "A" extending longitudinally along the length of the transfer cylinder and circumferentially between gripper edge 38A and tail edge 38B, respectively. The transfer cylinder 10D is attached to the delivery shaft 36 by longitudinally spaced hubs 40, 42 and 44. Additionally, center alignment marks 135 are formed on the cylinder flanges portions 52, 54 and on the curved support surface 38 of the cylindrical rim 34, as shown in FIG. 14. The purpose of the center alignment marks 130 is to facilitate the precise alignment and attachment of the integrated cover to the transfer cylinder. As described previously, center alignment marks 220 may also be formed on the integrated cover for the same purpose.

The hubs 40, 42 and 44 are connected to the cylinder 34 by webs 46, 48 and 50, and support the transfer cylinder 10D for rotation on the delivery shaft 36 of the printing press 12 in a manner similar to the mounting arrangement disclosed in my U.S. Pat. No. 3,791,644. In the embodiment shown in FIG. 14, the delivery cylinder 10D includes opposed elongated integral flanges 52, 54, which extend generally inwardly from the surface of the cylinder rim portion 34. The flanges 52 and 54 include elongated flat surfaces for securing an integrated cover as described below. As described herein, transfer cylinders may have alternative configurations for accommodating the various means for releasably attaching the integrated cover to the transfer cylinder as described herein.

Referring to FIG. 15B, a cross-sectional view of preferred transfer cylinder is shown for use with the Lithrone Series printing press of FIG. 13B. Transfer cylinder 10 is designed and configured to accept a pair of covers, with a first cover covering about one-half of the external support surface 38 of the transfer cylinder and a second cover covering about the remaining one-half of the surface 38. Two integrated covers 100 as described herein are releasably attached to transfer cylinder 10 at the tail edge 118 and the gripper edge 116 with flat clamp bar 72 held in place with a series of spring loaded screws spaced along the length of the clamp bar.

The function and operation of the transfer cylinders and associated grippers of the printing units are believed to be well known to those familiar with multi-color sheet fed presses, and need not be described further except to note that the impression cylinder 26 functions to press the sheets against the blanket cylinders 24 which applies ink to the sheets, and the transfer cylinders 10 guide the sheets away from the impression cylinders with the wet printed side of each sheet facing against the support surface of the transfer cylinder 10. Since each transfer cylinder 10 supports the printed sheet with the wet printed side facing against the transfer cylinder support surface, the transfer cylinder 10 is provided with an integrated cover as described herein. The integrated cover is releasably attached to the transfer cylinder by means for releasably attaching the integrated cover to a transfer cylinder. In an embodiment shown in FIG. 1 SA, the integrated cover is connected to the transfer cylinder flanges 52 and 54 by the hook and loop (i.e., VELCRO) fastener strips 59, 61. Other suitable releasably attaching means include clamps; mechanical fasteners such as screws; mechanical take up reels or any other forms of mechanical roll up bars (often referred to collectively as reel cylinders); adhesives such as double sided adhesive tape; tack strips; magnetic strips and the like. Upon installation of the integrated cover, the flexible jacket covering is movable relative to the cylinder base cover as described previously.

An integrated cover of the present invention is simple, inexpensive, and provides advantages over previous anti-marking systems for transfer cylinders, and in particular advantages over T-Y paper and non-tack film. Whereas moisture, washing, and/or cleaning are detrimental to both T-Y paper and non-tack film in that such causes each to delaminate and fail over time, the present invention retains moisture, including moisture from the dampening system that contains ink repellant chemicals, in the flexible jacket cover which actually helps to prevent ink buildup and marking. In contrast, T-Y paper and non-tack films do not move relative to the transfer cylinder, resulting is the printing image slapping or hitting the exact same area on the T-Y paper or non-tack films, leading to increased ink buildup, moisture penetration, and resultant marking problems. The integrated cover is disposable, which eliminates the need for periodic maintenance of the transfer cylinder coverings and provides for fresh, clean substrate support surfaces both on the flexible jacket covering and the cylinder base cover upon each new installation, thereby reducing/eliminating ink buildup and resultant marks on the processed substrates. Health and safety hazards to workers from cleaning; hazardous material disposal costs and problems; and the labor, press down time, and wasted material costs of cleaning the transfer cylinder support surfaces are eliminated by the present invention. The flexible jacket covering and cylinder base cover are integrated into a single, convenient unit, thereby speeding and simplifying installation on a transfer cylinder by reducing the number of components that must be individually aligned, attached, and trimmed. Optional alignment means on the integrated cover further simplify and speed installation. Given that a printing press may have numerous transfer cylinders, eliminating periodic maintenance and simplifying and speeding installation greatly increases efficiency by reducing press down time and labor costs and reducing the amount of off-specification printed material associated with press stoppages. Anti-static embodiments improve substrate handling by eliminating electrostatic charges, and resultant problems such as ink accumulation/encrustation and static cling. Also, an integrated cover often provides a lower cost solution for press operators than other anti-marking systems, particularly when taking into account the savings in labor, press down time, and wasted printing material. Such advantages will be further recognized and appreciated in the context of the following example.

EXAMPLE

Figure 16:
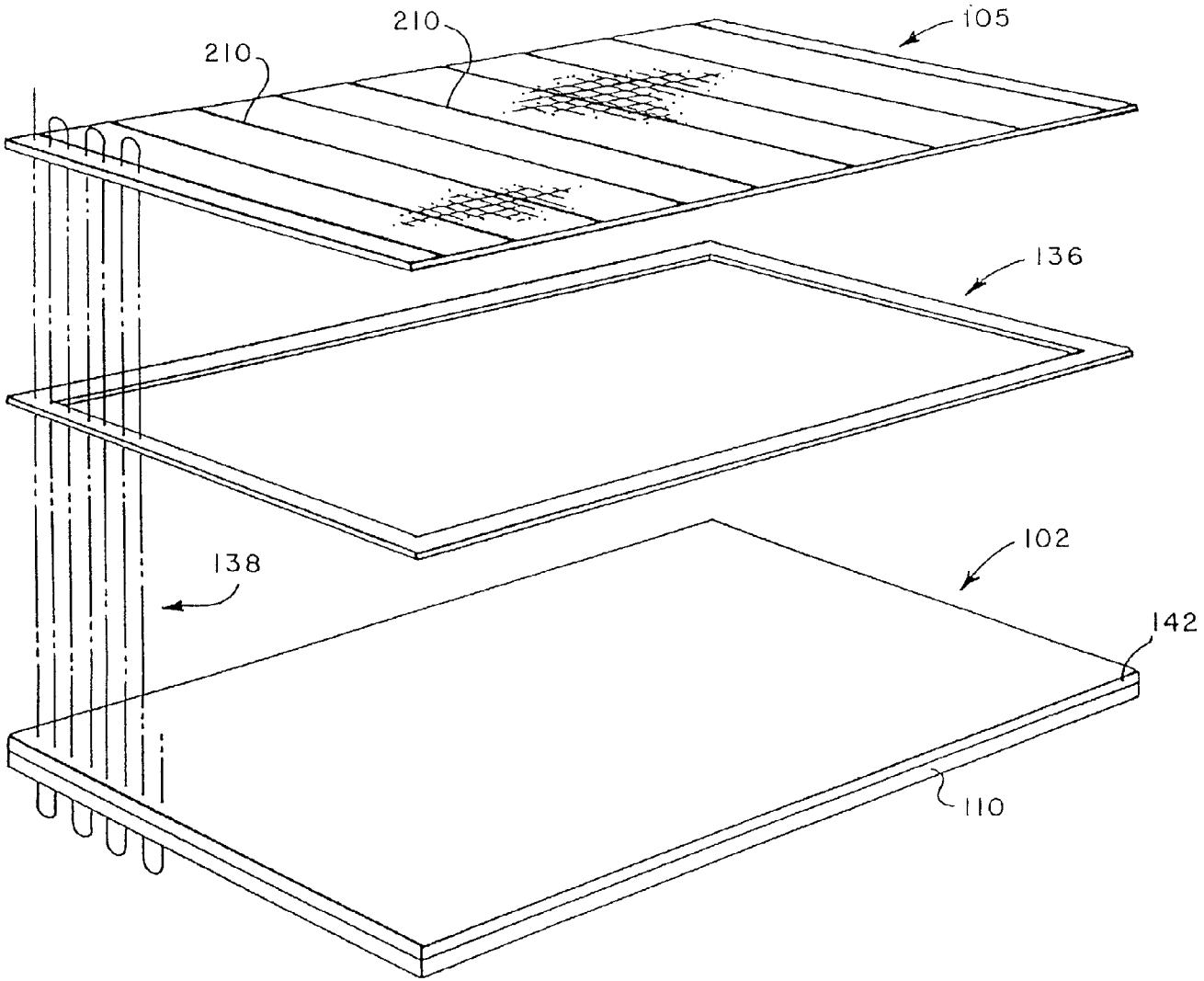
FIG. 16 is an exploded view of a preferred integrated, anti-marking cover.
Figure 17:
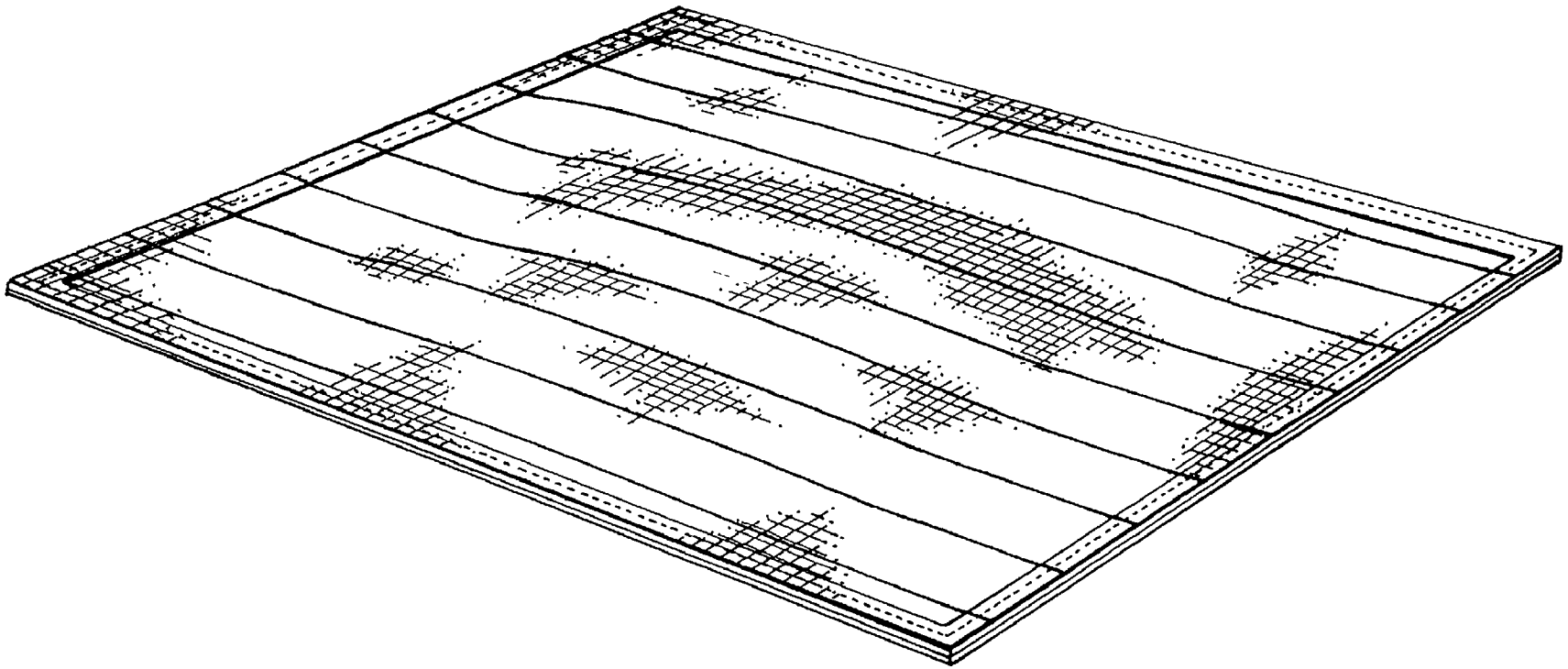
FIGS. 17–22 are perspective views of a preferred integrated, anti-marking cover.
Figure 18:
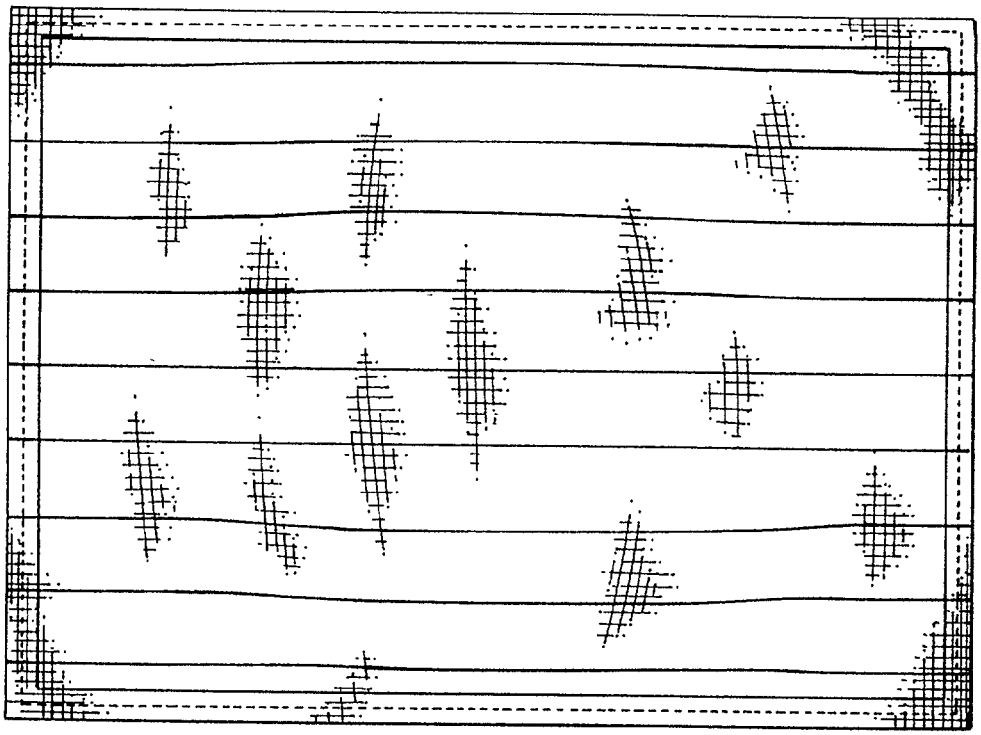
Figure 19:
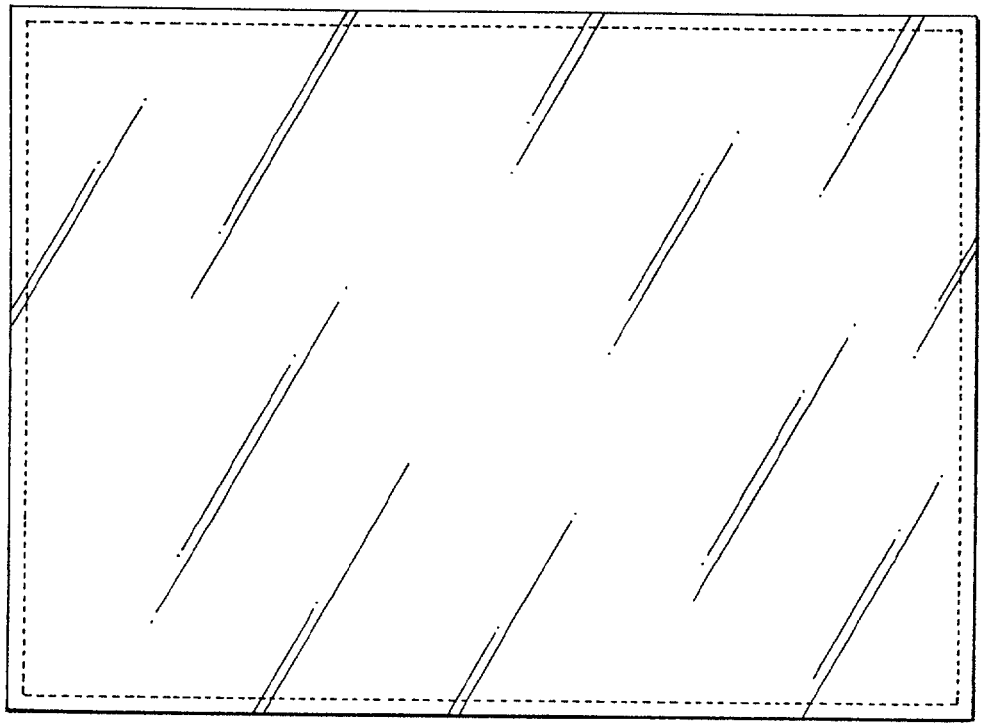
Figure 20:
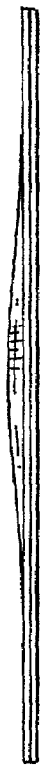
Figure 21:
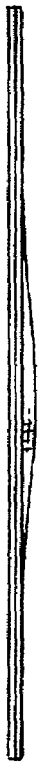
Figure 22:
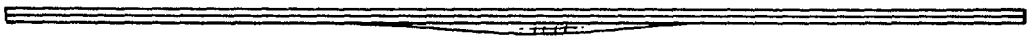
Figure 23:
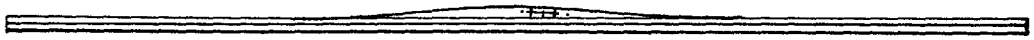

The following is an example of the manufacture of a preferred embodiment of an integrated cover according to the present invention designed to fit, among others, a 40 inch Lithrone Series printing press made by Komori Corp. Referring to FIG. 16, a precut flexible jacket covering 105 comprising a forty-mesh weave (i.e., 28 treads per inch in the warp direction×32 threads per inch in the weft direction), 70 denier weight cotton cheesecloth is provided. The precut flexible jacket covering is a rectangle measuring about 42 inches (1066.8 mm) in the warp direction, about 26 inches (660.4 mm) in the weft direction, and is about 0.007 inch (0.2 mm) thick. The cheesecloth comprises an interwoven mesh of blue weft and warp strands, which define a blue background field having a lattice pattern. The cheesecloth further comprises a plurality of contrasting alignment stripes 210 that are silver in color and run in the warp direction. The silver alignment stripes are spaced about ¾ inch (19.1 mm) apart in the weft direction. Each alignment stripe comprises a single silver conductive thread of Negastat static dissipative yarn, available from DuPont Corporation. The Negastat threads preferably are 70 denier comprising 3 carbon fibers covered by a protective sheath of polyester or nylon.

A precut cylinder base cover 102 is provided that comprises a Mylar carrier sheet 110 (i.e., the bottom surface) laminated with a coating 142 of PTFE and carbon black (i.e., the top surface), the laminate being known as CHEMLAM RLPR400 and available from St. Gobain Corporation. The precut cylinder base cover measures about 42 inches (1066.8 mm) in the warp direction, about 25 inches (635 mm) in the weft direction, and is about 0.004 inch (0.1 mm) thick. The Mylar carrier sheet is clear and PTFE/carbon black coating is black such that, when viewed from the Mylar side (i.e., the bottom surface) the laminate has a reflective sheen.

The cylinder base cover is placed on a workspace and a heat set tape 136 is applied to the top surface. The heat set tape comprises a strip of heat set adhesive in tape form with a layer of pressure sensitive adhesive on one side, the pressure sensitive adhesive typically protected by a removable liner material, the heat set tape being Thermo-Bond Film 669 available from 3M Corporation. The heat set tape typically comes in a roll that is ¼ inch (6.4 mm) wide and is cut to length to fit the edge dimensions of the base cover (taking into account the thickness of the tape), in this case two 42 inch (1066.8 mm) strips and two 25 inch (635 mm) strips. The protective liner is removed from the pressure sensitive side of the heat set tape, and the tape is applied about flush to each edge (i.e., gripper, tail, operator, and gear) of the cylinder base cover with the pressure adhesive side against the top surface of the cylinder base cover. Next, the flexible jacket covering is attached to the cylinder base cover one edge at a time.

The flexible jacket covering is placed on the cylinder base cover such that the bottom of the flexible jacket covering is in contact with the top of the cylinder base cover and the gripper edges are aligned about flush. Using a heat machine, the flexible jacket covering is bonded to the heat set tape on the gripper edge. The flexible jacket covering is adjusted such that movement of the flexible jacket covering relative to the cylinder base cover is about ¾ inch (19.1 mm) (i.e., the distance between two adjacent silver alignment stripes) in the weft direction, and the flexible jacket covering is bonded to the heat set tape flush on the tail edge. The flexible jacket covering is further adjusted such that movement of the flexible jacket covering relative to the cylinder base cover is evenly distributed in the warp and weft directions, and the flexible jacket covering is bonded to the heat set tape flush on the operator and gear edges. After bonding the flexible jacket covering to the heat set tape on all edges, the movement of the flexible jacket covering relative to the cylinder base cover is double-checked. Where sufficient movement as previously described is present, the edges of the flexible jacket covering and cylinder base cover are stitched together with a single row of stitching 138 running the length of each edge and positioned in about the center of the heat set tape (i.e., about ⅛ inch (3.2 mm) inward from each edge). The edges are trimmed, when necessary, to remove any excess material and provide for flush edges. Bonding the heat set tape to the cheesecloth material prevents edge fraying (i.e., produces a clean edge for easier installation) and reinforces the edges to better hold the stitching and reduce edge pull-aparts. An exploded view of the various components combined during manufacture of the integrated cover is shown in FIG. 16. The completed integrated cover is shown in FIGS. 17–23. A cross section showing the edge configuration is shown in FIG. 2A.

While preferred embodiments of the invention have been shown and described, modifications thereof can be made by one skilled in the art without departing from the spirit and teachings of the invention. The embodiments described herein are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

What we claim as our invention is:

1. A method of manufacturing an anti-marking cover for a transfer cylinder in a rotary printing press, comprising:

providing a cylinder base cover;

providing a flexible jacket covering of a defined size with respect to the cylinder base cover;

attaching the jacket covering to the base cover where the location of the attaching on tbe jacket covering and on the base cover combined with the size of the flexible jacket covering with respect to the base cover defines a fixed amount of movement of unattached portions of tke flexible jacket covering relative to the cylinder base cover, wherein the attaching is not releasable attaching; and delivering the attached anti-marking cover to the end user after the attaching is completed which further comprising using two means of attaching substantially along the same attachment points on the jacket covering and the base cover.

2. The method of claim 1, wherein the flexible jacket covering and cylinder base cover are attached along their edges.

3. The method of claim 1 wherein the flexible jacket covering and cylinder base cover are stitched along their edges.

4. The method of claim 1 further comprising adhering the flexible jacket covering to the cylinder base cover prior to delivering the anti-marking cover to the end user.

5. The method of claim 1, wherein the flexible jacket covering and cylinder base cover are stitched and adhered along their edges.

6. The method of claim 5 wherein the edges of the flexible jacket covering are bonded by the adhesive such that fraying thereof is minimized.

7. The method of claim 1 wherein the fixed amount of movement is effective to provide anti-marking support and transfer of processed substrates during printing operations.

8. The method of claim 1 wherein the fixed amount of movement is from about 1/16 to about 4 inches in the weft direction and from about 1/32 to about 1 inch in the warp direction.

9. The method of claim 1 wherein the fixed amount of movement is such that an end play of the flexible jacket covering relative to the cylinder base cover is about equal on a cylinder gripper end and a cylinder tail end of the anti-marking cover.

10. The method of claim 1 wherein the flexible jacket covering is centered circumferentially as well as longitudinally upon installation of the anti-marking cover on the transfer cylinder.

11. The method of claim 1 wherein the fixed amount of movement accounts far tightening of the flexible jacket covering upon installation of the anti-marking cover on the transfer cylinder.

12. The method of claim 1 wherein the fixed amount of movement accounts for a reduction in relative movement in the weft direction between the flexible jacket covering and the cylinder base cover upon installation of the anti-marking cover on the transfer cylinder.

13. The method of claim 9 wherein the flexible jacket covering further comprises alignment stripes running in the warp direction, and the amount of end play is about equal to the distance between the alignment stripes.

14. The method of claim 13 wherein the amount of end play is about ¾ inch.

15. The method claim 1, wherein the cylinder base cover comprises a film.

16. The method of claim 15, wherein the film further comprises a fluoropolymer coating on a polymer layer and the coating faces the flexible jacket covering.

17. A method of manufacturing an anti-marking cover for a transfer cylinder in a rotary printing press, comprising:

(a) providing a cylinder base cover sized to fit the transfer cylinder;

(b) providing a flexible jacket covering sized about equal to or slightly larger than the cylinder base cover;

(c) stitching a first edge of the flexible jacket covering to a corresponding first edge of the cylinder base cover;

(d) adjusting the amount of movement of the flexible jacket covering relative to the cylinder base cover in a first direction;

(e) stitching a second edge of the flexible jacket covering to a corresponding second edge of the cylinder base cover;

(f) stitching a third edge of the flexible jacket covering to a corresponding third edge of the cylinder base cover;

(g) adjusting the amount of movement of the flexible jacket covering relative to the cylinder base cover in a second direction; and (h) stitching a fourth edge of the flexible jacket covering to a corresponding fourth edge of the cylinder base cover.

18. The method of claim 17 wherein the edges are attached by stitching, adhesive, or both.

19. The method of claim 17 wherein the first and second edges are opposite one another and wherein the third and fourth edges are opposite one another.

20. The method of claim 17, wherein the cylinder base cover comprises a film;

wherein the stitching penetrates the film in the cylinder base cover; and wherein the stitching locations on the flexible jacket covering and the cylinder base cover fix the amount of movement of the unattached portions of the flexible jacket covering relative to the cylinder base cover.

21. The method of claim 20, further comprising the flexible jacket covering adhered to the cylinder base cover.

22. The method of claim 21, wherein the flexible jacket covering and cylinder base cover are stitched and adhered along their edges.

23. The method of claim 20, wherein the film comprises a polymer layer.

24. The method of claim 23, wherein the film further comprises a coating on the polymer layer.

25. The method of claim 24, wherein the coating faces the flexible jacket covering and further comprises a fluoropolymer.

26. The method of claim 20, wherein the flexible jacket covering comprises a fabric, wherein the fabric further comprises cotton, hemp, wool, silk, linen, nylon, rayon, polyester, polyacrylate, polyolefin, polyimide, polyamide, or combinations thereof.

27. The method of claim 20, wherein the flexible jacket covering further comprises alignment stripes.

28. The method of claim 20, wherein the flexible jacket covering further comprises a fabric having alignment stripes formed from conductive strands.

29. The method of claim 17 wherein the stitching of step (e) fixes the adjusted amount of movement of step (d).

30. The method of claim 17 wherein the stitching of step (h) fixes the adjusted amount of movement of step (g).

31. The method of claim 29 wherein the stitching of step (h) fixes the adjusted amount of movement of step (g).

32. A method of manufacturing an anti-marking cover for a transfer cylinder in a rotary printing press, comprising:

(a) providing a cylinder base cover sized to fit the transfer cylinder:

(b) providing a flexible jacket covering sized about equal to or slightly larger than the cylinder base cover;

(c) applying adhesive strips to the edges of the cylinder base cover; and (d) attaching the edges of the flexible jacket covering to the edges of the cylinder base cover via the adhesive strips, wherein step (d) further comprises:

(i) attaching a first edge of the flexible jacket covering to a corresponding first edge of the cylinder base cover;

(ii) adjusting the amount of movement of the flexible jacket covering relative to the cylinder base cover in a first direction;

(iii) attaching a second edge of the flexible jacket covering to a corresponding second edge of the cylinder base cover;

(iv) attaching a third edge of the flexible jacket covering to a corresponding third edge of the cylinder base cover;

(v) adjusting the amount of movement of the flexible jacket covering relative to the cylinder base cover in a second direction; and (vi) attaching a fourth edge of the flexible jacket covering to a corresponding fourth edge of the cylinder base cover.

33. The method of claim 32 wherein the first and second edges are opposite one another and wherein the third and fourth edges are opposite one another.

34. The method of claim 32 further comprising stitching the edges of the flexible jacket covering to the edges of the cylinder base cover.

35. The method of claim 34, wherein the stitching locations on the flexible jacket covering end the cylinder base cover fix the amount of movement of the flexible jacket covering relative to the cylinder base cover.

36. The method of claim 35 wherein the flexible jacket covering and cylinder base cover are stitched along their edges.

37. The method of claim 35 wherein the fixed amount of movement is effective to provide anti-marking support and transfer of processed substrates during printing operations.

38. The method of claim 35 wherein the fixed amount of movement is from about 1/16 to about 4 inches in the weft direction and from about 1/32 to about 1 inch in the warp direction.

39. The method of claim 35 wherein the fixed amount of movement is such that an end play of the flexible jacket covering relative to the cylinder base cover is about equal on a cylinder gripper end and a cylinder tail end of the anti-marking cover.

40. The method of claim 39 wherein the flexible jacket covering further comprises alignment stripes running in the warp direction, and the amount of end play is about equal to the distance between the alignment stripes.

41. The method of claim 40 wherein the amount of end play is about 3/4 inch.

42. The method of claim 35 wherein the flexible jacket covering is centered circumferentially as well as longitudinally upon installation of the anti-marking cover on the transfer cylinder.

43. The method of claim 35 wherein the fixed amount of movement accounts for tightening of the flexible jacket covering upon installation of the anti-marking cover on die transfer cylinder.

44. The method of claim 35 wherein the fixed amount of movement accounts for a reduction in relative movement in the weft direction between the flexible jacket covering and the cylinder base cover upon installation of the anti-marking cover on the transfer cylinder.

45. The method of claim 32 wherein the edges of the flexible jacket covering are bonded by the adhesive such that fraying thereof is minimized.

* * * * *

UNITED STATES PATENT AND TRADEMARK OFFICE

CERTIFICATE OF CORRECTION

PATENT NO. : 7,082,873 B2
APPLICATION NO. : 10/083785
DATED : August 1, 2006
INVENTOR(S) : Howard W. DeMoore et al.

It is certified that error appears in the above-identified patent and that said Letters Patent is hereby corrected as shown below:

Claim 11, Col. 19, line 6, replace “far” with --for--.

Claim 43, Col. 22, line 7, replace “die” with --the--.

Signed and Sealed this

Twenty-sixth Day of May, 2009

JOHN DOLL
*Acting Director of the United States Patent and Trademark Office*